US011459224B2

(12) United States Patent
Lee et al.

(10) Patent No.: US 11,459,224 B2
(45) Date of Patent: Oct. 4, 2022

(54) BEVERAGE MAKER AND METHOD OF CONTROLLING THE SAME

(71) Applicant: LG Electronics Inc., Seoul (KR)

(72) Inventors: Daewoong Lee, Seoul (KR); Kyungbin Lee, Seoul (KR); Jinpyo Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 16/689,586

(22) Filed: Nov. 20, 2019

(65) Prior Publication Data

US 2020/0156922 A1 May 21, 2020

(30) Foreign Application Priority Data

Nov. 20, 2018 (KR) ..... 10-2018-0143728

(51) Int. Cl.
*B67D 1/12* (2006.01)
*B67D 1/00* (2006.01)
*B67D 1/04* (2006.01)

(52) U.S. Cl.
CPC ..... *B67D 1/1243* (2013.01); *B67D 1/0081* (2013.01); *B67D 1/0431* (2013.01); (Continued)

(58) Field of Classification Search
CPC .. B67D 1/0081; B67D 1/0085; B67D 1/1243; B67D 2001/1259; B67D 2001/1261; B67D 2001/1263; B67D 2001/1265
See application file for complete search history.

(56) References Cited

U.S. PATENT DOCUMENTS 6,237,652 B1 5/2001 Nelson
6,751,525 B1 * 6/2004 Crisp, III ..... B67D 3/0006 700/241

(Continued)

FOREIGN PATENT DOCUMENTS

WO WO9829328 7/1998
WO WO9842612 10/1998
WO WO2008005564 1/2008

OTHER PUBLICATIONS

European Search Report in European Application No. 19209715, dated May 28, 2020, 2 pages.

*Primary Examiner* — Andrew D StClair
(74) *Attorney, Agent, or Firm* — Fish & Richardson P.C.

(57) ABSTRACT

A beverage maker includes: a container; a fermentation tank; a beverage dispenser including a lever configured to control dispensing of the beverage and a limit switch configured to be turned on and off based on manipulation of the lever; a beverage dispensing channel that connects the container and the beverage dispenser and that guides the beverage; a beverage dispensing valve disposed in the beverage dispensing channel; a pressure sensor that measures gas pressure inside the container; and a controller. The controller detects whether the limit switch is turned on, opens the beverage dispensing valve to dispense the beverage accommodated in the container through the beverage dispenser based on detecting that the limit switch is turned on, determines a gas pressure value corresponding to the gas pressure inside the container measured by the pressure sensor, and determines a dispensed amount of beverage based on the gas pressure value.

10 Claims, 9 Drawing Sheets

(52) U.S. Cl.
CPC .... *B67D 1/0437* (2013.01); *B67D 2001/0089* (2013.01); *B67D 2001/0493* (2013.01)

(56) References Cited

U.S. PATENT DOCUMENTS

| | | | | |
|---|---|---|---|---|
| 8,601,936 | B2 * | 12/2013 | Williams | C12G 1/0206 99/281 |
| 2013/0048668 | A1 * | 2/2013 | Osborne | B67D 1/0884 222/1 |
| 2013/0081443 | A1 * | 4/2013 | Rasmussen | B67D 1/1247 73/19.06 |
| 2017/0335256 | A1 * | 11/2017 | Park | C12C 11/006 |

* cited by examiner

BEVERAGE MAKER AND METHOD OF CONTROLLING THE SAME

CROSS-REFERENCE TO RELATED APPLICATIONS

This application claims priority under 35 U.S.C. 119 and 365 to Korean Patent Application No. 10-2018-0143728, filed on Nov. 20, 2018, in the Korean Intellectual Property Office, the disclosure of which is incorporated herein by reference.

FIELD

The present disclosure relates to a beverage maker, and more particularly, to a beverage maker and a method of controlling the same for determining a dispensed amount of beverage and controlling operation of an air pump in dispensing beverage.

BACKGROUND

Beverage collectively refers to drinkable liquid such as alcohol or tea. For example, the beverage may be divided into various categories such as water or beverage to solve thirst, juice beverages with unique flavor and taste, refreshing beverages giving refreshing sensation, beverages with an arousal effect, or alcoholic beverages with an alcohol effect.

One example of beverage may be beer. The beer is an alcoholic beverage that may be produced by making juice of malt, which is made by sprouting barley, filtering the juice, adding hop, and fermenting yeast.

Consumers may purchase ready-made products that are made and sold by a beer maker or may produce home beer (i.e., handmade beer or house beer) by directly fermenting beer ingredients at home or in a bar.

House beer may be made in a variety of types compared to ready-made products and may be made to better suit the consumer's taste.

The ingredients for making beer may include water, liquid malt, hop, yeast, flavoring additive, and the like.

Leaven, which is called yeast, may be added to liquid malt to ferment the liquid malt and assist production of alcohol and carbonic acid.

The flavor additives are additives that may enhance the taste of beer, such as fruit, syrup, vanilla beans, and the like.

In some cases, house beer making may include three stages, namely, a wort production operation, a fermentation operation, and an aging operation, which may take about two to three weeks from the wort production operation to the aging operation.

In some cases, it may be important to maintain an optimum temperature during the fermentation stage. In some cases, the users may desire convenience in producing more beer with a simple method.

In recent years, a beverage maker has been gradually used for making a beer-like beverage in a home or a bar.

SUMMARY

The present disclosure describes a beverage maker that can determine a dispensed amount without a flow detection sensor when beverage accommodated in a fermentation container included in a fermentation tank is dispensed.

The present disclosure also describes a beverage maker that can effectively control an air pump to provide pressure to the fermentation container during beverage dispensing.

According to one aspect of the subject matter described in this application, a beverage maker includes: a container configured to accommodate beverage therein; a fermentation tank that accommodates the container therein; a beverage dispenser configured to dispense the beverage, where the beverage dispenser includes a lever configured to control dispensing of the beverage and a limit switch configured to be turned on and off based on manipulation of the lever; a beverage dispensing channel that connects the container and the beverage dispenser and that is configured to guide the beverage; a beverage dispensing valve disposed in the beverage dispensing channel; a pressure sensor configured to measure a gas pressure inside the container; and a controller. The controller is configured to: detect whether the limit switch is turned on; open the beverage dispensing valve to dispense the beverage accommodated in the container through the beverage dispenser based on detecting that the limit switch is turned on; determine a gas pressure value corresponding to the gas pressure inside the container measured by the pressure sensor; and determine a dispensed amount of beverage based on the gas pressure value.

Implementations according to this aspect may include one or more of the following features. For example, the controller may be configured to: determine gas pressure values corresponding to the gas pressure inside the container measured at a plurality of reference time points, respectively; and determine an individual dispensed amount of beverage corresponding to each of the plurality of reference time points based on each of the gas pressure values.

In some examples, the controller may be configured to: determine a first average pressure value of (i) a first gas pressure value corresponding to the gas pressure measured at a first time point and (ii) a second gas pressure value corresponding to the gas pressure measured at a second time point after an elapse of a reference duration from the first time point; and based on the first average pressure value, determine an average amount of beverage dispensed during the reference duration between the first time point and the second time point.

In some examples, the controller may be configured to: determine a third gas pressure value corresponding to the gas pressure inside the container measured based on detecting that the limit switch is turned off; determine a second average pressure value of the third gas pressure value and a fourth gas pressure value corresponding to the gas pressure measured at a time point prior to determination of the third gas pressure value; and based on the second average pressure value, determine an amount of beverage dispensed between the time point corresponding to the fourth gas pressure value and a time point corresponding to the third gas pressure value.

In some implementations, the controller may be configured to determine a remaining amount of beverage accommodated in the container based on the dispensed amount of beverage. In some examples, the beverage maker may further include a non-transitory memory device configured to store beverage information including a first remaining amount of beverage accommodated in the container, where the controller may be configured to: determine a second remaining amount of beverage based on a difference between the first remaining amount in the beverage information and the dispensed amount of beverage; and update the first remaining amount in the beverage information with the second remaining amount.

In some implementations, the beverage maker may further include a display, and the controller may be configured to display at least one of the dispensed amount of beverage or the remaining amount of beverage through the display.

In some implementations, the beverage maker may further include an air pump configured to inject air to a space defined between the fermentation tank and the container, and the controller may be configured to turn on the air pump based on the gas pressure value being less than a first reference pressure value. In some examples, the controller may be configured to turn off the air pump based on the gas pressure value being greater than or equal to a second reference pressure value that may be greater than the first reference pressure value.

In some implementations, the controller may be configured to: close the beverage dispensing valve; after the beverage dispensing valve is closed, control the pressure sensor to measure the gas pressure based on detecting that the limit switch is turned off; determine whether the gas pressure value is less than the second reference pressure value; and maintain the air pump to be turned off based on the gas pressure value being greater than or equal to the second reference pressure value.

In some implementations, the beverage dispenser may further include an elevation body connected to the lever and configured to move upward to thereby open the beverage dispensing channel based on manipulation of the lever. The elevation body may include a manipulation protrusion that extends toward the limit switch and that is configured to contact the limit switch based on the elevation body moving upward. In some examples, the limit switch may include a terminal that extends to the elevation body and that is configured to contact the elevation body based on the elevation body moving upward.

According to another aspect, a method is described for controlling a beverage maker. The method includes detecting whether the limit switch is turned on; based on detecting that the limit switch is turned on, opening the beverage dispensing valve; based on opening the beverage dispensing valve, determining a gas pressure value corresponding to the gas pressure inside the container measured by the pressure sensor; and determining a dispensed amount of beverage based on the gas pressure value.

Implementations according to this aspect may include one or more of the following features. For example, determining the gas pressure value may include: determining gas pressure values corresponding to the gas pressure inside the container measured at a plurality of reference time points, respectively. Determining the dispensed amount of beverage may include determining an individual dispensed amount of beverage corresponding to each of the plurality of reference time points based on each of the gas pressure values.

In some examples, determining the gas pressure values may include: determining a first average gas pressure value of (i) a first gas pressure value corresponding to the gas pressure measured at a first time point and (ii) a second gas pressure value corresponding to the gas pressure measured at a second time point after an elapse of a reference duration from the first time point. Determining the dispensed amount of beverage may include: based on the first average gas pressure value, determining an average amount of beverage dispensed during the reference duration between the first time point and the second time point.

In some implementations, the method may further include: detecting that the limit switch is turned off; determining a third gas pressure value corresponding to the gas pressure inside the container measured based on detecting that the limit switch is turned off; determining a second average pressure value of the third gas pressure value and a fourth gas pressure value measured at a time point prior to determination of the third gas pressure value; and based on the second average pressure value, determining an amount of beverage dispensed between the time point corresponding to the fourth gas pressure value and a time point corresponding to the third gas pressure value.

In some implementations, the method may further include determining a remaining amount of beverage accommodated in the container based on the dispensed amount of beverage. In some examples, the method may further include displaying at least one of the dispensed amount of beverage or the remaining amount of beverage through a display.

In some implementations, the beverage maker further may include: a fermentation tank that accommodates the container therein; and an air pump configured to inject air to a space defined between the fermentation tank and the container. The method further may include turning on the air pump based on the gas pressure value being less than a first reference pressure value.

In some implementations, the method may further include turning off the air pump based on the gas pressure value being greater than equal to a second reference pressure value that is greater than the first reference pressure value.

The details of one or more implementations are set forth in the accompanying drawings and the description below. Other features will be apparent from the description and drawings, and from the claims.

DETAILED DESCRIPTION

Hereinafter, detailed implementations of the present disclosure will be described in detail with reference to the accompanying drawings.

Although beer is exemplified as a beverage made by using a beverage maker in this specification, a kind of beverages is not limited to beer. For example, various kinds of beverages may be made through the beverage maker according to implementations.

Figure 1:
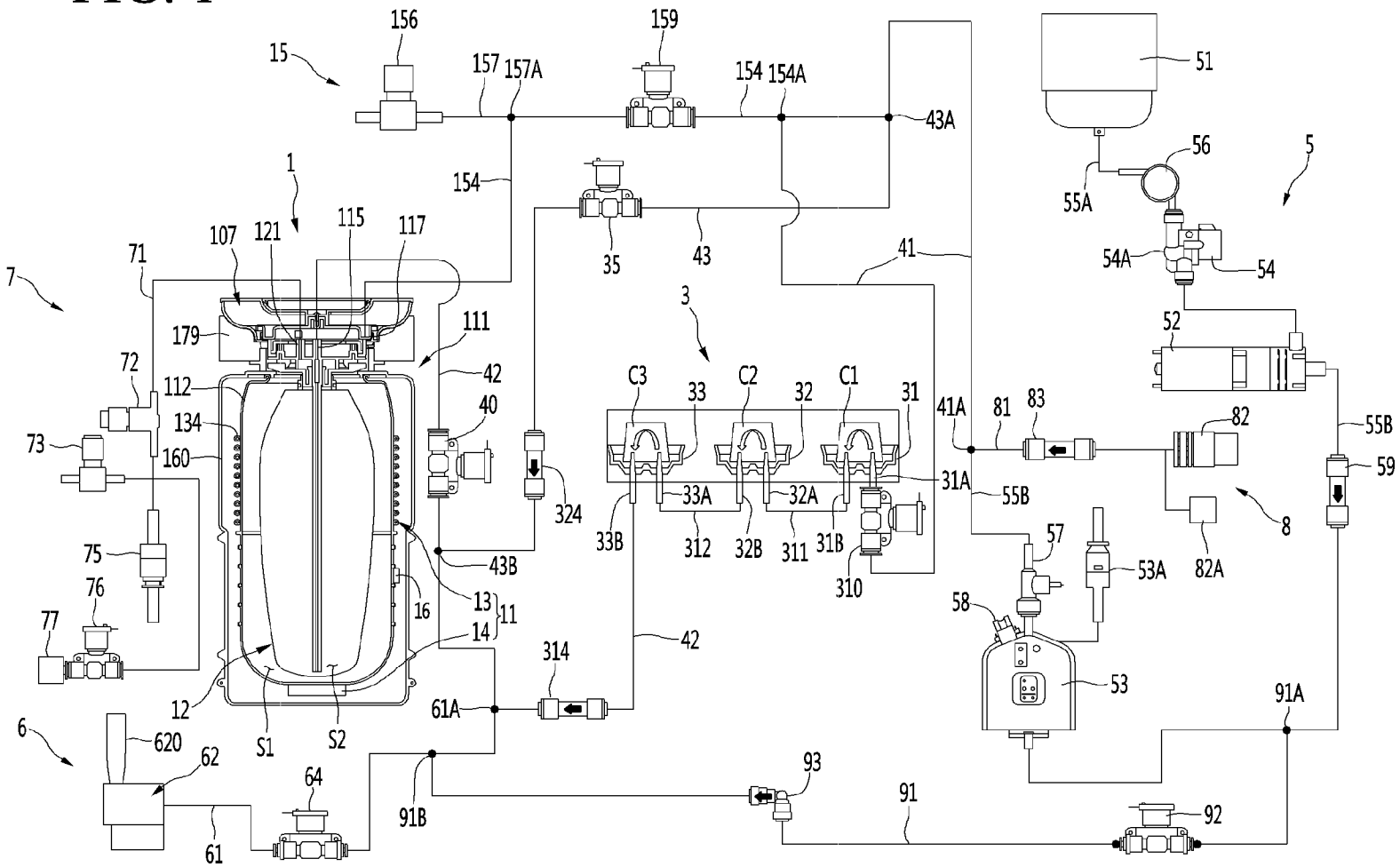
FIG. 1 is a view illustrating an example configuration of a beverage maker.

FIG. 1 is a view illustrating an example configuration of the beverage maker.

A beverage maker may include a fermentation module 1. A beverage may be fermented in the fermentation module 1.

The beverage maker may include a temperature controller that controls an inner temperature of the fermentation module 1.

The beverage maker may include a water supply module 5. The water supply module 5 may supply water.

The beverage maker may include ingredient supplier 3 provided with ingredient accommodating parts 31, 32, and 33 in which ingredients required for making the beverage are accommodated.

The beverage maker may include main channels 41 and 42 connecting the water supply module 5 to the fermentation module 1.

The beverage maker may include a beverage dispenser 6 for dispensing the beverage made in the fermentation module 1 to the outside.

The beverage dispenser 6 may be connected to a second main channel 42. Thus, the beverage dispensed from the fermentation module 1 may be guided to the beverage dispenser 6 by passing through a portion of the second main channel 42.

The beverage maker may further include a gas discharger 7. The gas discharger 7 may be connected to the fermentation module 1 to discharge a gas generated while the beverage is made.

The beverage maker may further include an air injector 8 for injecting air. The air injector 8 may be connected to the water supply module 5 or a first main channel 41. The air injector 8 may include an air pump 82.

The beverage maker may further include an air controller 15 controlling a pressure between an inner wall of a fermentation tank 112 and an outer surface of a fermentation container 12.

In some implementations, the beverage maker may further include a sub channel 91. The sub channel 91 may connect the water supply module 5 to the beverage dispenser 6.

Hereinafter, the fermentation module 1 will be described in detail.

The fermentation module 1 may include a fermentation tank module 111 having an opening and fermentation lid 107 opening and closing the opening.

The fermentation tank module 111 may include a fermentation case 160 and a fermentation tank 112 accommodated in the fermentation case 160 and having an inner space S1. The insulation part may be provided between the fermentation case 160 and the fermentation tank 112. The fermentation tank module 111 may further include a lid seating body 179 on which the fermentation lid 107 is seated.

Each of the fermentation case 160 and the fermentation tank 112 may be provided as an assembly of a plurality of members. The fermentation case 160 may define an outer appearance of the fermentation tank module 111.

The fermentation lid 107 may seal the inside of the fermentation tank module 111 and be disposed on the fermentation tank module 111 to cover the opening. A main channel, particularly, a main channel connecting portion 115 connected to a second main channel 42 may be provided in the fermentation lid 107.

A fermentation container 12 may be accommodated in the fermentation tank 112.

The fermentation container 12 may be provided as a separate container so that the beverage ingredients and the made beverage do not stain an inner wall of the fermentation tank 112. The fermentation container 12 may be separably disposed in the fermentation tank 112. The fermentation container 12 may be seated on the fermentation tank 112 to ferment the beverage within the fermentation tank 112. After the fermentation container 12 is used, the fermentation container 12 may be withdrawn to the outside of the fermentation tank 112. In some examples, the fermentation container 12 and the fermentation tank 112 define a space therebetween.

The fermentation container 12 may be a pack containing the ingredients for making the beverage. The fermentation container 12 may be made of a flexible material. Thus, the fermentation container 12 may be easily inserted into the fermentation tank 112 and be contracted and expanded by a pressure. However, this implementation is not limited thereto. For example, the fermentation container 12 may be made of a PET material.

The fermentation container 12 may have a beverage making space S2 in which the beverage ingredients are accommodated, and the beverage is made. The fermentation container 12 may have a size less than that of the inner space S1 of the fermentation tank 112.

The fermentation container 12 may be inserted and accommodated into the fermentation tank 112 in the state in which the ingredients are contained in the fermentation container 12. The fermentation container 12 may be inserted into the fermentation tank 112 and then accommodated in the fermentation tank 112 in the state in which the fermentation lid 107 is opened.

The fermentation lid 107 may seal the fermentation tank 112 after the fermentation container 12 is inserted into the fermentation tank 112. The fermentation container 12 may assist the fermentation of the ingredient in the state in which the fermentation container 12 is accommodated in the space S1 that is sealed by the fermentation container 12 and the fermentation lid 107. The fermentation container 12 may be expanded by the pressure therein during the making of the beverage. The fermentation container 12 may be pressed by the air within the fermentation tank 112 when the beverage contained in the fermentation container 12 is dispensed, and the air is supplied between an inner surface of the fermentation tank 112 and the fermentation container 12.

As the fermentation container 12 is accommodated in the fermentation tank 112 and the fermentation lid 107 is closed, the main channel connecting portion 115 of the fermentation lid 107 may connect the second main channel 42 and the beverage making space S2 inside the fermentation container 12.

Thus, water supplied from the water supply module 5 while beverage is made may be injected into the fermentation container 12 through the second main channel 42 and the main channel connecting portion 115. An ingredient accommodated in the ingredient supplier 3 may be injected into the fermentation container 12 through the second main channel 42 and the main channel connecting portion 115. Beverage that is completely made in the fermentation container 12 may pass through the main channel connecting portion 115, the second main channel 42, and a beverage dispensing channel 61 and may be dispensed to the outside through a dispenser 62.

In some examples, the beverage maker may be configured to inject the water and ingredient supplied while beverage is made into the fermentation container 12 through the main channel connecting portion 115 formed on the fermentation lid 107 to be open and closed. The beverage maker may be implemented to dispense the beverage accommodated in the fermentation container 12 by the dispenser 62 when beverage is dispensed through the main channel connecting portion 115. That is, the beverage maker may be implemented to inject or dispense water, an ingredient, and beverage through the main channel connecting portion 115 formed on the fermentation lid 107 to be open and closed, thereby simplifying a configuration for connection between the second main channel 42 and the fermentation container 12.

The fermentation tank 112 may be disposed in the fermentation case 160. The fermentation tank 112 may have an outer circumference surface and a bottom surface, which are spaced apart from the inner surface of the fermentation case 160. In more detail, the outer circumference the fermentation tank 112 may be spaced apart from an inner circumference of the fermentation case 160, and an outer bottom surface of the fermentation tank 112 may be spaced apart from an inner bottom surface of the fermentation case 160.

In some examples, the insulation part may be provided between the fermentation case 160 and the fermentation tank 112. The insulation part may be disposed in the fermentation case 160 to surround the fermentation tank 112. Thus, the fermentation tank 112 may be constantly maintained in temperature.

The insulation part may be made of a material such as foamed polystyrene or polyurethane which has high thermal insulating performance and absorbs vibration.

The fermentation tank 112 may include a temperature sensor 16 for measuring the temperature of the fermentation tank 112.

The temperature sensor 16 may be mounted on a circumferential surface of the fermentation tank 112. The temperature sensor 16 may be disposed below an evaporator 134 wound around the fermentation tank 112.

Hereinafter, the temperature controller 11 will be described in detail.

The temperature controller 11 may change an inner temperature of the fermentation tank module 111. In more detail, the temperature controller 11 may change a temperature of the fermentation tank 112.

The temperature controller 11 may heat or cool the fermentation tank 112 to control a temperature of the fermentation tank 112 at an optimal temperature for fermenting the beverage.

The temperature controller 11 may include at least one of a refrigerant cycle device 13 and a heater 14. However, this implementation is not limited thereto. For example, the temperature controller 11 may include a thermoelement TEM.

The refrigerant cycle device 13 may control the temperature of the fermentation tank 112 to cool a temperature of the fermentation tank 112. The refrigerant cycle device 13 may include a compressor, a condenser, an expansion mechanism, and an evaporator 134.

The evaporator 134 may be disposed to contact an outer surface of the fermentation tank 112. The evaporator 134 may be provided as an evaporation tube wound around an outer surface of the fermentation tank 112. The evaporator 134 may be accommodated between the fermentation tank 112 and the insulation part to cool the fermentation tank 112 that is insulated by the insulation part.

The temperature controller 11 may further include a heater 14 heating the fermentation tank 112. The heater 14 may be installed to contact the bottom surface of the fermentation tank 112. The heater 14 may be provided as a heat generation heater that generates heat when power is applied. The heater 14 may be provided as a plate heater.

Thus, the natural convection of a fluid may be generated inside the fermentation tank 112 by the evaporator 134 and the heater 14, and temperature distribution inside the fermentation tank 112 and the fermentation container 12 may be uniform.

Hereinafter, the main channels 41 and 42 and a bypass channel 43 will be described.

As described above, the main channels 41 and 42 may include a first main channel 41 connecting the water supply module 5 to the ingredient supplier 3 and a second main channel 42 connecting the ingredient supplier 3 to the fermentation module 1.

That is, the first main channel 41 may guide water supplied from the water supply module 5 to the ingredient supplier 3, and the second main channel 42 may guide the mixture of the ingredients and the water, which are extracted from the ingredient supplier 3, to the fermentation module 1.

The first main channel 41 may have one end 41A connected to the water supply module 5 and the other end connected to the ingredient supplier 3, more particularly, an inlet 31A of a first ingredient accommodating part 31, which will be described below in more detail.

An ingredient supply valve 310 opening and closing the first main channel 41 may be installed in the first main channel 41. The ingredient supply valve 310 may be provided in the ingredient supplier 3.

The ingredient supply valve 310 may be opened when additives accommodated in the ingredient accommodating parts 31, 32, and 33 are put to open the first main channel 41. The ingredient supply valve 310 may be opened when the ingredient accommodating parts 31, 32, and 33 are cleaned to open the first main channel 41.

The second main channel 42 may have one end connected to a main channel connecting portion 115 of the fermentation module 1 and the other end connected to the ingredient supplier 3, more particularly, an outlet 33B of a final ingredient accommodating part 33, which will be described below in more detail.

A main valve 40 opening and closing the second main channel 42 may be installed in the second main channel 42. Also, a main check valve 314 for allowing the fluid to flow from the ingredient supplier 3 to the fermentation module 1 may be installed in the second main channel 42. That is, the main check valve 314 may prevent the fluid from flowing back to the ingredient supplier 3.

The main check valve 314 may be disposed between the main valve 40 and the ingredient supplier 3 with respect to the second main channel 42.

The main valve 40 may be opened when the water is supplied to the fermentation container 12 to open the second main channel 42. The main valve 40 may be closed while the fermentation tank 112 is cooled to close the second main channel 42. The main valve 40 may be opened when the air is injected into the fermentation container 12 to open the second main channel 42. The main valve 40 may be opened when the additives are supplied into the fermentation container 12 to open the second main channel 42. The main valve 40 may be closed to seal the inside of the fermentation container 12 during the fermentation of the ingredients. The main valve 40 may be closed to seal the inside of the fermentation container 12 when the beverage is aged and stored. The main valve 40 may be opened when the beverage is dispensed by the beverage dispenser 6 to open the second main channel 4. The beverage within the fermentation container 12 may pass through the main valve 40 to flow to the beverage dispenser 6.

The main channels 41 and 42 may be provided as one continuous channel when the beverage maker does not include the ingredient supplier 3.

When the beverage maker includes the ingredient supplier 3, the beverage maker may further include a bypass channel 43 configured to allow the water or the air to bypass the ingredient accommodating parts 31 and 32.

The bypass channel 43 may bypass the ingredient accommodating parts 31, 32, and 33 and then be connected to the first main channel 41 and the second main channel 42.

The bypass channel 43 may have one end 43A connected to the first main channel 41 and the other end 43B connected to the second main channel 42. In more detail, the bypass channel 43 may have one end 43A connected to the first main channel 41 between the water supply module 5 and the ingredient supply valve 310 and the other end 43B connected to the second main channel 42 between the main valve 40 and the ingredient supplier 3.

A bypass valve 35 opening and closing the bypass channel 43 may be installed in the bypass channel 43.

The bypass valve 35 may be opened when the water supplied from the water supply module 5 is supplied to the fermentation container 12 to open the bypass channel 43. The bypass valve 35 may be opened when the air injected from the air injector 8 is supplied to the fermentation container 12 to open the bypass channel 43. The bypass valve 35 may be opened when the bypass channel 43 is cleaned to open the bypass channel 43.

In some implementations, a bypass check valve 324 allowing the fluid to flow from the first main channel 41 to the second main channel 42 may be installed in the bypass channel 43. That is, the fluid may flow only from the first main channel 41 to the second main channel 42 but may not flow in the opposite direction.

The bypass check valve 324 may be disposed between the bypass valve 35 and the second main channel 42 with respect to the bypass channel 43.

Hereinafter, the ingredient supplier 3 will be described in detail.

When beer is made by using the beverage maker, the ingredients for making the beer may include water, malt, yeast, hop, flavoring additives, and the like.

The beverage maker may include all of the ingredient supplier 3 and the fermentation container 12. The ingredients for making the beverage may be accommodated to be divided into the ingredient supplier and fermentation container 12. A portion of the ingredients for making the beverage may be accommodated in the fermentation container 12, and the remaining ingredients may be accommodated in the ingredient supplier 3. The remaining ingredients accommodated in the ingredient supplier 3 may be supplied to the fermentation container 12 together with the water supplied from the water supply module 5 and mixed with the portion of the ingredients accommodated in the fermentation container 12.

A main ingredient that is essential for making the beverage may be accommodated in the fermentation container 12, and the additives added to the main ingredient may be accommodated in the ingredient supplier 3. In this case, the additives accommodated in the ingredient supplier 3 may be mixed with the water supplied from the water supply module 5 and supplied to the fermentation container 12 and then be mixed with the main ingredient accommodated in the fermentation container 12.

The main ingredient accommodated in the fermentation container 12 may have a capacity greater than that of other ingredients. For example, when the beer is made, the main material may be the malt of the malt, the yeast, the hop, and the flavoring additives. Also, the additive accommodated in the ingredient supplier 3 may be the other ingredient except for the malt of the ingredient for making the beer, for example, the yeast, the hop, and the flavoring additives.

In some cases, the beverage maker may not include the ingredient supplier 3 but include the fermentation container 12. In this case, the main ingredient may be accommodated in the fermentation container 12, and the user may directly put the additives into the fermentation container 12.

If the beverage maker includes all the ingredient supplier 3 and the fermentation container 12, the beverage may be more easily made. Hereinafter, the case in which the beverage maker includes all of the ingredient supplier 3 and the fermentation container, will be described as an example. However, this implementation is not limited to the case in which the beverage maker includes all of the ingredient supplier 3 and the fermentation container 12.

The ingredients within the fermentation container 12 may be fermented as time elapses, and the beverage made in the fermentation container 12 may flow to the second main channel 42 through the main channel connecting portion 115 and also flow from the second main channel 42 to the beverage dispenser 6 so as to be dispensed.

The ingredients that are necessary for making the beverage may be accommodated in the ingredient supplier 3, and the water supplied from the water supply module 5 may pass through ingredient supplier 3. For example, when the beverage made in the beverage maker is beer, the ingredient accommodated in the ingredient supplier 3 may be yeast, hop, flavoring additives, and the like.

The ingredient accommodated in the ingredient supplier 3 may be directly accommodated into an ingredient accommodating parts 31, 32, and 33 provided in the ingredient supplier 3. At least one ingredient accommodating part 31, 32, and 33 may be provided in the ingredient supplier 3. The plurality of ingredient accommodating parts 31, 32, and 33 may be provided in the ingredient supplier. In this case, the ingredient accommodating parts 31, 32, and 33 may be partitioned with respect to each other.

Inlets 31A, 32A, and 33A through which the fluid is introduced and outlets 31B, 32B, and 33B through which the fluid is discharged may be provided in the ingredient accommodating parts 31, 32, and 33, respectively. The fluid introduced into the inlet of one ingredient accommodating part may be mixed with the ingredients within the ingredient accommodating parts and then discharged through the outlet.

The ingredients accommodated in the ingredient supplier 3 may be accommodated in ingredient containers C1, C2, and C3. In this case, the ingredient containers C1, C2, and C3 may be accommodated in the ingredient accommodating parts 31, 32, and 33, and each of the ingredient accommodating parts 31, 32, and 33 may be called an ingredient container mounting part.

The ingredient containers C1, C2, and C3 may be configured in a capsule, a pod, or the like, but are not limited thereto.

When the ingredients are accommodated in the ingredient containers C1, C2, and C3, the ingredient supplier 3 may be configured so that the ingredient containers C1, C2, and C3 are seated and withdrawn. The ingredient supplier may be provided as an ingredient container kit assembly in which the ingredient containers C1, C2, and C3 are separably accommodated.

For example, a first additive, a second additive, and a third additive may be accommodated in the ingredient supplier 3. The first additive may be yeast, the second additive may be hop, and the third additive may be a flavoring additive. The ingredient supplier 3 may include a first (or initial) ingredient container mounting part 31 in which a first ingredient container C1 containing the first additive is accommodated, a second (or intermediate) ingredient container mounting part 32 in which a second ingredient container C2 containing the second additive is accommodated, and a third (or final) ingredient container mounting part 33 in which a third ingredient container C3 containing the third additive is accommodated.

The ingredients contained in the ingredient accommodating part or the ingredient containers C1, C2, and C3 may be extracted by a water pressure of the water supplied from the water supply module 5.

When the ingredients are extracted by the water pressure, the water supplied from the water supply module 5 to the first main channel 41 may pass through the ingredient accommodating part or the ingredient containers C1, C2, and C3 and then be mixed with the ingredients, and the ingredients accommodated in the ingredient accommodating part or the ingredient containers C1, C2, and C3 may flow to the second main channel together with the water.

A plurality of additives different from each other may be accommodated to be divided in the ingredient supplier 3. For example, when the beer is made, the plurality of additives accommodated in the ingredient supplier 3 may be the yeast, the hop, and the flavoring additive, which are accommodated to be divided from each other.

When the plurality of ingredient accommodating parts are provided in the ingredient supplier 3, the plurality of ingredient accommodating parts 31, 32, and 33 may be connected in series to each other in a flow direction of the water.

In more detail, the ingredient supplier 3 may include at least one connecting channel 311 and 312 connecting the outlet of one ingredient accommodating part of the plurality of ingredient accommodating parts 31, 32, and 33 to the inlet of the other ingredient accommodating part.

In some implementations, the plurality of ingredient accommodating parts 31, 32, and 33 may include a first ingredient accommodating part 31 and a final ingredient accommodating part 33. The plurality of ingredient accommodating parts 31, 32, and 333 may further include an intermediate ingredient accommodating part 32.

The inlet 31A of the first ingredient accommodating part 31 may be connected to the first main channel 41, and the outlet 33B of the final ingredient accommodating part 33 may be connected to the second main channel 42.

The intermediate ingredient accommodating part 32 may be disposed between the first ingredient accommodating part 31 and the second ingredient accommodating part 32 in the flow direction of the fluid. The inlet 32A and the outlet 32B of the intermediate ingredient accommodating part 32 may be connected to the connecting channels 311 and 312 different from each other.

As illustrated in FIG. 1, when three ingredient accommodating parts are provided in the ingredient supplier 3, the outlet 31B of the first ingredient accommodating part 31 may be connected to the inlet 32A of the intermediate ingredient accommodating part 32 through the first connecting channel 311, and the outlet 32B of the intermediate ingredient accommodating part 32 may be connected to the inlet 33A of the final ingredient accommodating part 33 through the second connecting channel 312.

In this case, the water introduced into the inlet 31A of the first ingredient accommodating part 31 through the first main channel 41 may flow to the first connecting channel 311 through the outlet 31B together with the first additive accommodated in the first ingredient accommodating part 31.

The fluid (the mixture of the water and the first additive) introduced into the inlet 32A of the intermediate ingredient accommodating part 32 through the first connecting channel 311 may flow to the second connecting channel 312 through the outlet 32B together with the second additive accommodated in the intermediate ingredient accommodating part 32.

The fluid (the mixture of the water and the first and second additives) introduced into the inlet 33A of the final ingredient accommodating part 33 through the second connecting channel 312 may flow to the second main channel 42 through the outlet 33B together with the third additive accommodated in the final ingredient accommodating part 33.

The fluid (the mixture of the water and the first, second, and third additives) discharged through the second main channel 42 may be guided to the main channel connecting portion 115 of the fermentation module 1 and then introduced into the fermentation container 12.

However, the configuration of the ingredient supplier is not limited thereto. For example, when the intermediate ingredient accommodating part is not provided, two ingredient accommodating parts may be provided in the ingredient supplier 3. In this case, one ingredient accommodating part may be the initial ingredient accommodating part, and the other ingredient accommodating part may be the final ingredient accommodating part. The outlet of the initial ingredient accommodating part and the inlet of the final ingredient accommodating part may be connected to each other by the connecting channel.

As another example, when the intermediate ingredient accommodating part is provided in plurality, four or more ingredient accommodating parts may be provided in the ingredient supplier 3. In this case, one ingredient accommodating part may be the initial ingredient accommodating part, the other ingredient accommodating part may be the final ingredient accommodating part, and the remaining ingredient accommodating part may be the intermediate ingredient accommodating part. In this case, since the connection between the ingredient accommodating parts in series is easily understood by the person skilled in the art, their detailed descriptions will be omitted.

Since the plurality of ingredient accommodating parts 31, 32, and 33 are connected in series to each other, the channel configuration of the ingredient supplier 3 may be simplified. In addition, since the additives contained in the ingredient containers C1, C2, and C3 are extracted at once, a time taken to extract the additives may decrease. The user may not have to worry about the mounting order of the ingredient containers C1, C2, and C3, and thus malfunction due to the mounting of the ingredient containers C1, C2, and C3 in erroneous order may not occur. Also, the ingredient supplier 3 may be minimized in water leakage point to improve reliability.

When the ingredients accommodated in the ingredient supplier 3 are accommodated in the ingredient containers C1, C2, and C3, the first ingredient accommodating part 31 may be called an initial ingredient container mounting part, the intermediate ingredient accommodating part 32 may be called an intermediate ingredient container mounting part, and the final ingredient accommodating part 33 may be a final ingredient container mounting part.

Hereinafter, the water supply module 5 will be described in detail.

The water supply module 5 may include a water tank 51, a water supply pump 52 for pumping water within the water tank 51, and a water supply heater 53 for heating the water pumped by the water supply pump 52.

The water supply module 5 may further include the water supply pump 52 for pumping water within the water tank 51 and the water supply heater 53 for heating the water pumped by the water supply pump 52.

The water tank 51 and the water supply pump 52 may be connected to a water tank discharge channel 55A, and the water contained in the water tank 51 may be introduced into the water supply pump 52 through the water tank discharge channel 55A.

The water supply pump 52 and one end of the first main channel 41 may be connected to a water supply channel 55B, and the water discharged from the water supply pump may be guided to the first main channel 41 through the water supply channel 55B.

A flow meter 56 for measuring a flow rate of the water discharged from the water tank 51 may be installed in the water tank discharge channel 55A.

Also, a flow rate control valve 54 for controlling the flow rate of the water discharged from the water tank 51 may be installed in the water tank discharge channel 55A. The flow rate control valve 54 may include an operation-in motor.

Also, a thermistor 54A for measuring a temperature of the water discharged from the water tank 51 may be installed in the water tank discharge channel 55A. The thermistor 54A may be built in the flow rate control valve 54.

A water supply check valve 59 for preventing the water from flow back to the water supply pump 52 may be installed in the water supply channel 55B.

The water supply heater 53 may be installed in the water supply channel 55B.

A thermal fuse 58 for interrupting a circuit to cutoff current applied to the water supply heater 53 when a temperature is high may be installed in the water supply heater 53.

The water supply module 5 may further include a safety valve 53A. The safety valve 53A may communicate with the inside of the heater case of the water supply heater 53. The safety valve 53A may restrict a maximum inner pressure of the heater case. For example, the safety valve 53A may restrict the maximum inner pressure of the heater case to a pressure of about 3.0 bar.

The water supply module 5 may further include a water supply temperature sensor 57 for measuring a temperature of the water passing through the water supply heater 53. The water supply temperature sensor 57 may be installed in the water supply heater 53. Alternatively, the water supply temperature sensor 57 may be disposed at a portion of the water supply channel 55B behind the water supply heater 53 in the flow direction of the water. Also, the water supply temperature sensor 57 may be installed in the first main channel 41.

When the water supply pump 52 is driven, the water within the water tank 51 may be introduced into the water supply pump 52 through the water tank discharge channel 55A, and the water discharged from the water supply pump 52 may be heated in the water supply heater 53 while flowing through the water supply channel 55B and then be guided to the first main channel 41.

Hereinafter, the beverage dispenser 6 will be described.

The beverage dispenser 6 may be connected to the second main channel 42.

In more detail, the beverage dispenser 6 may include a dispenser 62 for dispensing the beverage and a beverage dispensing channel 61 connecting to the dispenser 62 to the second main channel 42.

The beverage dispensing channel 61 may have one end (i.e., connection portion 61A) connected between the main check valve 314 and the main valve 40 with respect to the second main channel 42 and the other end connected to the dispenser 62.

A beverage dispensing valve 64 opening and closing the beverage dispensing channel 61 may be installed in the beverage dispensing channel 61.

The beverage dispensing valve 64 may be opened when the beverage is dispensed to open the beverage dispensing channel 61. The beverage dispensing valve 64 may be opened when residual water is removed to open the beverage dispensing channel 61. The beverage dispensing valve 64 may be opened when the beverage dispenser is cleaned to open the beverage dispensing channel 61.

An anti-foaming part may be provided in the beverage dispensing channel 61, and an amount of foam of the beverage flowing from the second main channel 42 to the beverage dispensing channel 61 may be minimized while passing through the anti-foaming part. A mesh for filtering the foam may be provided in the anti-foaming part.

When the beverage is dispensed, the beverage dispensing valve 64 may be opened. When the beverage is not dispensed, the closed state of the beverage dispensing valve 64 may be maintained.

Hereinafter, the gas discharger 7 will be described in detail.

The gas discharger 7 may be connected to the fermentation module 1 to discharge a gas generated in the fermentation container 12.

In more detail, the gas discharger 7 may include a gas discharge channel 71 connected to the fermentation module, a gas pressure sensor 72 installed in the gas discharge channel 71, and a gas discharge valve 73 connected behind the gas pressure sensor 72 in the gas discharge channel 71 in the gas discharge direction.

The gas discharge channel 71 may be connected to the fermentation module 1, particularly, the fermentation lid 107. A gas discharge channel connecting portion 121 to which the gas discharge channel 71 is connected may be provided in the fermentation lid 107.

The gas within the fermentation container 12 may flow into the gas discharge channel 71 and the gas pressure sensor 72 through the gas discharge channel connecting portion 121. The gas pressure sensor 72 may detect a pressure of the gas discharged to the gas discharge channel 71 through the gas discharge channel connecting portion 121 within the fermentation container 12.

The gas discharge valve 73 may be turned to be opened when the air is injected into the fermentation container 12 by the air injector 8. The beverage maker may uniformly mix the malt with the water by injecting the air into the fermentation container 12. Here, foam generated in the liquid malt may be discharged from the upper portion of the fermentation container 12 to the outside through the gas discharge channel 71 and the gas discharge valve 73.

The gas discharge valve 73 may be turned on to detect fermentation during the fermentation process and then turned off to be closed.

The gas discharger 7 may further include the safety valve 75 connected to the gas discharge channel 71. The safety valve 75 may be connected behind the gas pressure sensor 72 in the gas discharge channel 71 in the gas discharge direction. The safety valve 75 may restrict a maximum pressure of the fermentation container 12 and the gas discharge channel 71. For example, the safety valve 75 may restrict the maximum pressure of the fermentation container 12 and the gas discharge channel 71 to a pressure of about 3.0 bar.

The gas discharger 7 may further include a pressure release valve 76.

The pressure release valve 76 may be connected to the gas discharge channel 71. The pressure release valve 76 and the gas discharge valve 73 may be selectively opened/closed.

The gas discharge channel 71 may be branched to be respectively connected to the gas discharge valve 73 and the pressure release valve 76.

A noise reducing device 77 may be mounted on the pressure release valve 76. The noise reducing device 77 may include at least one of an orifice structure and a muffler structure.

Even though the pressure release valve 76 is closed, an inner pressure of the fermentation container 12 may gradually decrease by the noise reducing device 77.

When the fermentation of the beverage progresses, the pressure release valve 76 may be opened to release the pressure in the state in which the inner pressure of the fermentation container 12 increases. The noise reducing device 77 may effectively reduce noise generated due to a difference in pressure of the inside and outside of the fermentation container 12.

The pressure release valve 76 may be open/close-controlled in a fermentation operation with relatively high internal pressure.

Hereinafter, the air injector 8 will be described.

The air injector 8 may be connected to the water supply channel 55B or the first main channel 41 to inject air. Hereinafter, for convenience of description, the case in which the air injector 8 is connected to the water supply channel 55B will be described as an example.

The air injector 8 may be connected to an opposite side of a sub channel 91, which will be described later, with respect to the water supply heater 53.

In this case, the air injected into the air injector 8 may pass through the water supply heater 53 to flow to the sub channel 91 together with the residual water within the water supply heater 53. Thus, the residual water within the water supply heater 53 may be removed to maintain a clean state of the water supply heater 53.

Alternatively, the air injected from the air injector 8 to the first main channel 41 may successively pass through the bypass channel 43 and the second main channel 42 and then be injected into the fermentation container 12. Thus, stirring or aeration may be performed in the fermentation container 12.

Alternatively, the air injected from the air injector 8 to the first main channel 41 may be guided to the ingredient supplier 3 to flow to the ingredient container mounting parts 31, 32, and 33. The residual water or residues within the ingredient containers C1, C2, and C3 or the ingredient container mounting parts 31, 32, and 33 may flow the second main channel 42 by the air injected by the air injector 8. The ingredient containers C1, C2, and C3 and the ingredient container mounting parts 31, 32, and 33 may be cleanly maintained by the air injected by the air injector 8.

The air injector 8 may include an air injection channel connected to the water supply channel 55B or the first main channel 41 and an air pump 82 connected to the air injection channel 81. The air pump 82 may pump the air to the air injection channel 81.

An air injection check valve 83 preventing the water flowing to the water supply channel 55B by the water supply pump 52 from being introduced into the air pump 82 through the air injection channel 81 may be installed in the air injection channel 81.

The air injector 8 may further include an air filter 82A. The air filter 82A may be provided in a suction part of the air pump 82, and thus, external air may be suctioned into the air pump 82 by passing through the air filter 82A. Thus, the air pump 82 may inject clean air into the air injection channel 81.

Hereinafter, the air controller 15 will be described in detail.

The air controller 15 may control a pressure between an inner wall of the fermentation tank 112 and an outer surface of the fermentation container 12.

The air controller 15 may supply air into a space between the fermentation container 12 and the fermentation tank 112. In some examples, the air controller 15 may exhaust the air within the space between the fermentation container 12 and the fermentation tank 112 to the outside.

The air controller 15 may include an air supply channel 154 connected to the fermentation module 1 and an exhaust channel 157 connected to the air supply channel 154 to exhaust the air to the outside.

The air supply channel 154 may have one end connected to the first main channel 41 and the other end connected to the fermentation module 1.

The air supply channel 154 may be connected to the fermentation module 1, particularly, the fermentation lid 107. An air supply channel connecting portion 117 to which the air supply channel 154 is connected may be provided in the fermentation module 1. The air supply channel connecting portion 117 may communicate with the space between the inner wall of the fermentation tank 112 and the outer surface of the fermentation container 12.

The air injected from the air injector 8 to the first main channel 41 may be guided between the outer surface of the fermentation container 12 and the inner wall of the fermentation tank 112 through the air supply channel 154.

The air injector 8 may function as an air supplier for supplying the air into the space between the fermentation container 12 and the fermentation tank 112 together with the air supply channel 154.

As described above, the air supplied into the fermentation tank 112 may press the fermentation container 12 between the outer surface of the fermentation container 12 and the inner wall of the fermentation tank 112.

The beverage within the fermentation container 12 may be pressed by the fermentation container 12 that is pushed by the air. When the main valve 40 and the beverage dispensing valve 64 are opened, the beverage may pass through the main channel connecting portion 115 to flow to the second main channel 42. The beverage flowing from the fermentation container 12 to the second main channel 42 may be dispensed to the outside through the beverage dispenser 6.

The air pump 82 may supply air so that a predetermined pressure occurs between the fermentation container 12 and the fermentation tank 112. Thus, a pressure at which the beverage within the fermentation container 12 is easily dispensed may be occur between the fermentation container 12 and the fermentation tank 112.

The air pump 82 may be maintained in the turn-off state while the beverage is dispensed. When the beverage is completely dispensed, the air pump 82 may be driven for next beverage dispensing and then stopped.

Thus, when the beverage is completely made, the beverage maker may dispense the beverage within the fermentation container 12 to the beverage dispensing channel 61 in the state in which the fermentation container 12 is disposed within the fermentation module 1 without withdrawing the fermentation container 12 to the outside of the fermentation module 1.

The air controller 15 may include a separate air supply pump with respect to the air injector 8. In this case, the air supply channel 154 may be connected to the air supply pump, but may not be connected to the first main channel 41. However, the injection of the air into the fermentation container 12 by the air pump 82 and the supplying of the air into the space between the fermentation container 12 and the fermentation tank 112 may be combined with each other to realize a compact product and reduce a manufacturing cost.

The exhaust channel 157 may function as an air exhaust passage, through which the air between the fermentation container 12 and the fermentation tank 112 is exhausted to the outside, together with a portion of the air supply channel 154.

The exhaust channel 157 may be disposed outside the fermentation module 1. The exhaust channel 157 may be connected to a portion of the air supply channel 154, which is disposed outside the fermentation tank 112.

The air supply channel 154 may include a first channel connected between a connecting portion 157A connected to the first main channel 41 and the exhaust channel 157 and a second channel connected between the connecting portion 154A connected to the exhaust channel 157 and the air supply channel connecting portion 117. The first channel may be an air supply channel for guiding the air pumped by the air pump 82 to the second channel. Also, the second channel may be an air supply and exhaust-combined channel for supplying the air passing through the air supply channel into the space between the fermentation tank 112 and the fermentation container 12 or guiding the air discharged from the space between the fermentation tank 112 and the fermentation container 12 to the exhaust channel 157.

The exhaust channel 157 may be connected to the exhaust valve 156 for opening and closing the exhaust channel 157.

The exhaust valve 156 may be opened so that the air between the fermentation container 12 and the fermentation tank 112 is exhausted to the outside when the fermentation container 12 is expanded while the beverage is made. The exhaust valve 156 may be controlled to be opened when the water is supplied by the water supply module 5. The exhaust valve 156 may be controlled to be opened when the air is injected by the air injector 8.

The exhaust valve 156 may be opened so that the air between the fermentation container 12 and the fermentation tank 112 is exhausted when the beverage within the fermentation container 12 is completely dispensed. The user may take the fermentation container out of the fermentation tank 112 when the beverage is completely dispensed. This is done because safety accidents occur when the inside of the fermentation tank 112 is maintained at a high pressure. The exhaust valve 156 may be controlled to be opened when the beverage within the fermentation container 12 is completely dispensed.

The air controller 15 may further include an air supply valve 159 that restricts the air pumped by the air pump 82 and supplied between the fermentation container 12 and the fermentation tank 112.

The air supply valve 159 may be installed in the air supply channel 154. In more detail, the air supply valve 159 may be installed between the connecting portion 154A of the first main channel 41 and the connecting portion 157A of the exhaust channel 157 in the air supply channel 154.

Hereinafter, the sub channel 91 will be described in detail.

The sub channel 91 may connect the water supply module 5 to the beverage dispenser 6. In more detail, the sub channel 91 may have one end 91A connected to the water supply channel 55B and the other end 91B connected to the beverage dispensing channel 61.

The sub channel 91 may be connected between the water supply pump 52 and the water supply heater 53 with respect to the water supply channel 55B.

Also, the sub channel 91 may be connected to the connecting portion 61A of the second main channel 42 and the beverage dispensing valve 64 with respect to the beverage dispensing channel 61.

The water supplied by the water supply pump 52 and the air pumped by the air pump 82 may be guided to the beverage dispensing channel 61 through the sub channel 91 and then be dispensed to the dispenser 62. Thus, the residual water or the beverage remaining in the beverage dispenser 6 may be removed.

A sub valve 92 opening and closing the sub channel 91 may be installed in the sub channel 91.

The sub valve 92 may be opened when the beverage is dispensed, or the cleaning is performed to open the sub channel 91.

Also, a sub check valve 93 for preventing the beverage of the beverage dispensing channel 61 from flowing back to the water supply module 5 may be installed in the sub channel 91. The sub check valve 93 may be disposed between the sub valve 92 and the beverage dispensing channel 61 with respect to the sub channel 91.

The sub channel 91 may function as a residual water removing channel of the water supply module 5. For example, when the air pump 82 is turned on in the state in which the air supply valve 159, the bypass valve 35, and the ingredient supply valve 310 are closed, the sub valve 92 is opened, the air injected into the air injection channel 81 may pass through the water supply heater 53 to flow to the sub channel 91. Then, the air may pass through the sub valve 92 to flow to the beverage dispensing channel 61 and then be dispensed to the dispenser 62. In this process, the air may be dispensed together with the water supply module 5, more particularly, the residual water remaining the water supply heater 53 and the water supply channel 55B so that residual water is removed.

The sub channel 91 may function as a cleaning channel. In more detail, beverage may be partially dispensed by the dispenser 62, and when a long time elapses up to next beverage dispensing, water may flow to the sub channel 91 to clean the dispenser 62 before the next beverage dispensing is performed.

Figure 2:
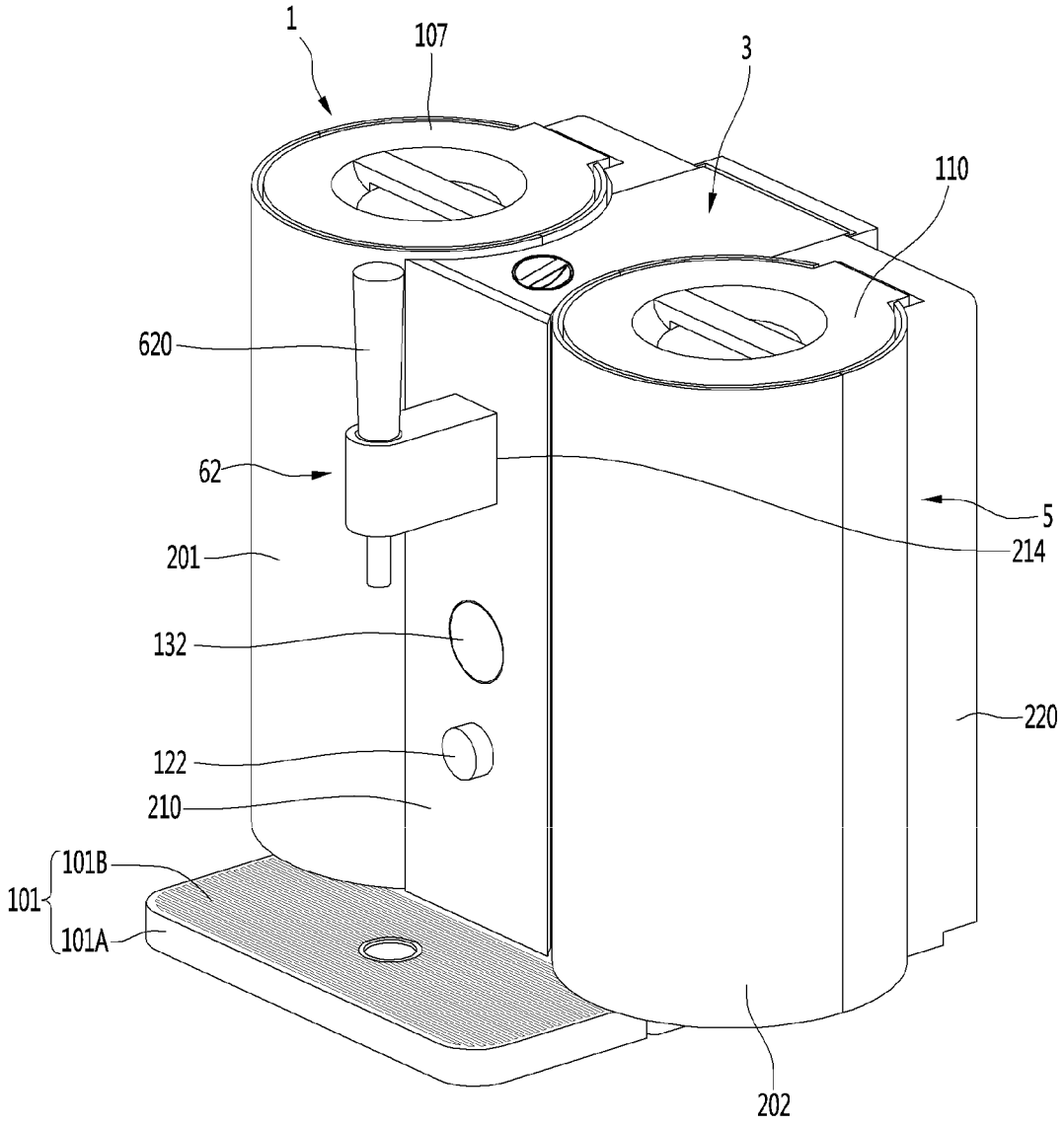
FIG. 2 is a perspective view illustrating an example of a beverage maker.

FIG. 2 is a perspective view showing an example of the beverage maker.

The beverage maker may further include a beverage container 101 that receives and stores a beverage dropping from the dispenser 62.

The beverage container 101 may include a container body 101A having a space in which the beverage dropping down from the dispenser 62 is accommodated. The beverage container 101 may include a container upper plate 101B disposed on a top surface of the container body 101A to cover a space within the container body 101A.

The container body 101A may protrude forward from a front portion of the base 100. The container body 101A may have an opened top surface.

The container upper plate 101B may cover an open upper plate of the container body 101A. A plurality of holes through which the beverage drops down into the container body 101A may be defined in the container upper plate 101B.

The beverage dropping around the beverage container of the beverage dropping down from the dispenser 62 may drop down onto the container upper plate 101B and be temporarily stored in the beverage container 101 through the holes of the container upper plate 101B. Thus, the surrounds of the beverage maker may be cleanly maintained.

The beverage maker may include the covers 201, 202, 210, and 220 that form an outer appearance. The covers 201, 202, 210, and 220 may be integrated together but a plurality of members may be configured to be coupled to each other in terms of manufacture and maintenance.

The covers 201, 202, 210, and 220 may include a fermentation module cover 201, a water tank cover 202, a front cover 210, and a rear cover 220.

Each of the fermentation module cover 201 and the water tank cover 202 may have a hollow shape. A portion of a circumferential surface of each of the fermentation module cover 201 and the water tank cover 202 may be opened. The open portion of the circumferential surface may be positioned inside the beverage maker and may not be exposed to the outside, and the beverage maker may be enhanced in terms of a design.

The fermentation module cover 201 and the water tank cover 202 surround at least portions of outer circumferences of the fermentation module 1 and the water tank 51, respectively. The fermentation module cover 201 and the water tank cover 202 fix the fermentation module 1 and the water tank 51 to protect the fermentation module 1 and the water tank 51 against an external impact.

The fermentation module cover 201 and the water tank cover 202 may be horizontally disposed to be spaced apart from each other.

The fermentation module cover 201 and the water tank cover 202 may have the same height and/or diameter. Thus, the beverage maker may be improved in design due to symmetric structure and unity of the outer appearance thereof.

An upper surface of the fermentation module cover 201 may be open and the fermentation lid 107 may be exposed upwards. In addition, an upper surface of the water tank cover 202 may be open and a water tank lid 110 may be exposed upwards. Thus, a user may easily open and close the fermentation lid 107 and the water tank lid 110.

The front cover 210 may configure an outer appearance of a front side of the beverage maker. The front cover 210 may cover a portion between the fermentation module cover 201 and the water tank cover 202 at a front side.

The front cover 210 may be disposed between the fermentation module cover 201 and the water tank cover 202. Opposite side ends of the front cover 210 may contact the fermentation module cover 201 and the water tank cover 202, respectively.

The front cover 210 may be shaped like a flat plate that is vertically disposed.

The height of the front cover 210 may be the same as the height of each of the fermentation module cover 201 and the water tank cover 202.

The dispenser 62 may be mounted on the front cover 210. The dispenser 62 may be disposed closer to an upper end of the front cover 210 than a lower end thereof. The dispenser 62 may be positioned above the beverage container 101. A user may manipulate the lever 620 of the dispenser 62 to dispense beverage.

In more detail, the dispensing valve mounting part 214 on which the dispenser 62 is installed may be formed on the front cover 210. The dispensing valve mounting part 214 may be formed to be closer to an upper end of the front cover 210 than a lower end thereof.

The beverage maker may include a display 132 for displaying various pieces of information of the beverage maker. The display 132 may be disposed on the front cover 210.

The display 132 may be formed not to be hidden by the dispenser 62 of the front cover 210. That is, the display 132 may not overlap the dispenser 62 in a horizontal direction.

The display 132 may include a display device such as a liquid crystal display (LCD), a light emitting diode (LED), or an organic light emitting diode (OLED), and a display printed circuit board (PCB) on which the display device is installed. The display PCB may be mounted on a bottom surface of the front cover 210 and may be electrically connected to a controller 440 (refer to FIG. 4) that will be described below.

The beverage maker may include an input interface 420 (refer to FIG. 4) for receiving a command related to making of the beverage maker.

The input interface 420 may include at least one of a touch pad for receiving a user command in a touch manner, a rotary knob that is rotated while being hold by a user, or a button pushed by the user.

For example, the input interface may include a rotary knob 122. The rotary knob 122 may be disposed on a front surface of the beverage maker. For example, the rotary knob 122 may be disposed below the display 132, but is not limited thereto.

The rotary knob 122 may function as a button that is pushed by the user. That is, the user may rotate the rotary knob 122 while holding the same or may push the front surface of the rotary knob 122 and may input a control command.

The input interface may include a touch pad 422 (refer to FIG. 4) that receives a user command in a touch manner. For example, the touch pad 422 may be integrated into the display 132, and in this case, the display 132 may function as a touchscreen.

The rear cover 220 may form an outer appearance of the beverage maker at a rear side. The rear cover 220 may cover a portion between the fermentation module cover 201 and the water tank cover 202 at a rear side.

The ingredient supplier 3 may be disposed between the fermentation module 1 and the water tank 51. Thus, when compared with a case in which the ingredient supplier 3 is disposed at a position except between the fermentation module 1 and the water tank 51, the ingredient supplier 3 may be more compact, and the ingredient supplier 3 may be protected by the fermentation module 1 and the water tank 51.

At least a portion of each of both side surfaces of the ingredient supplier 3 may be curved, and the curved surface may contact each of an outer circumference of the fermentation module cover 201 and an outer circumference of the water tank cover 202.

The ingredient supplier 3 may be disposed above the base 100 so as to be vertically spaced apart from the base 100. The ingredient supplier 3 may be disposed above the main frame 230.

The ingredient supplier 3 may be disposed between the front cover 210 and the rear cover 220 in the front and rear direction. A front surface of the ingredient supplier 3 may be covered by the front cover 210, and a rear surface of the ingredient supplier 3 may be covered by the second rear cover 270.

Figure 3:
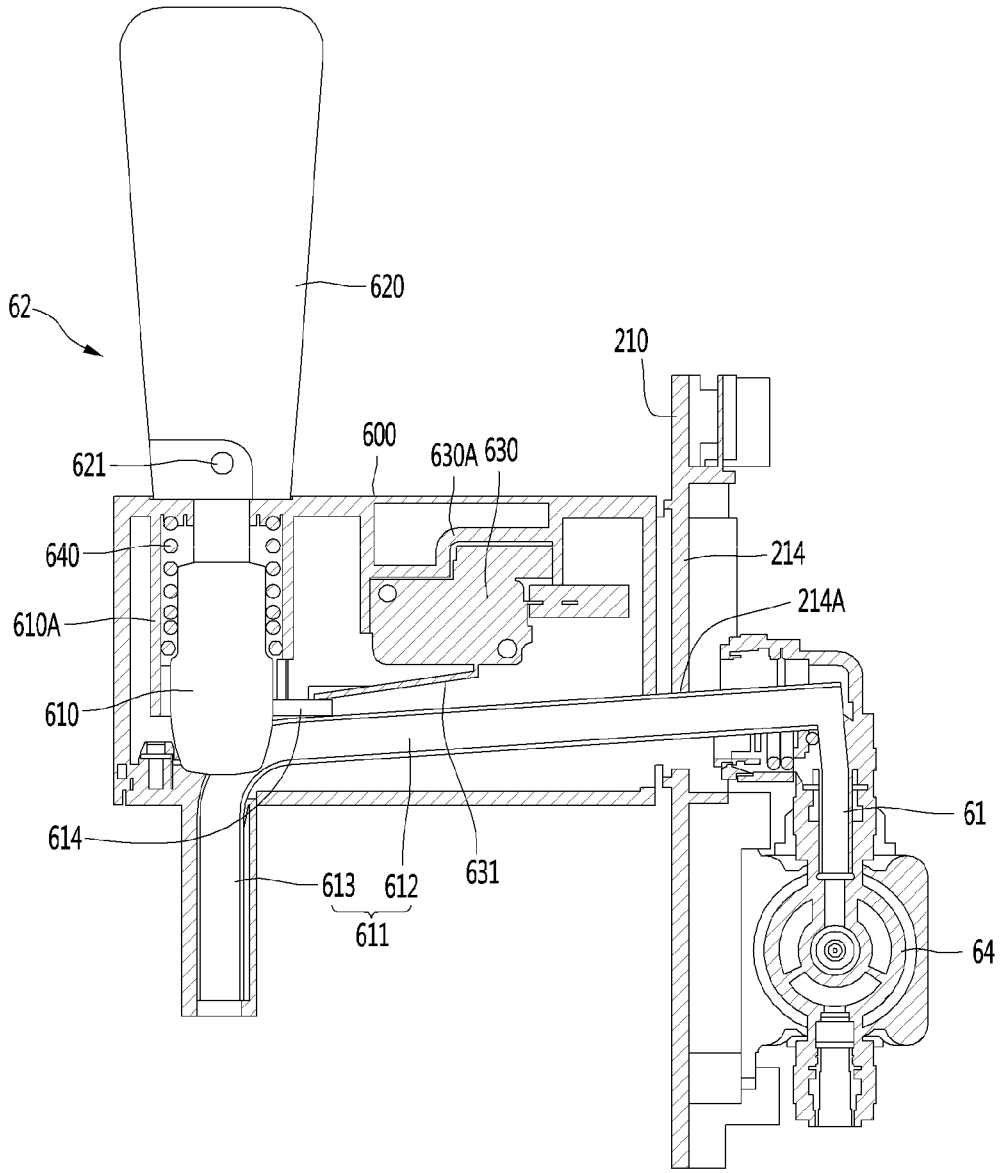
FIG. 3 is a cross-sectional view illustrating an example of a dispenser of the beverage maker.

FIG. 3 is a cross-sectional view illustrating an example of a beverage dispenser of the beverage maker.

A dispenser 62 of the beverage dispenser 6 (see FIG. 1) may include a dispenser body 600, an elevation body 610, a lever 620, and a limit switch 630.

A dispenser channel connected to the beverage dispensing channel 61 may be provided in the dispenser body 600.

The elevation body 610 may be disposed to be elevatable within the dispenser body 600.

The lever 620 may be rotatably connected to an upper portion of the elevation body 610 to elevate the elevation body 610 when rotating.

The limit switch 630 may be switched by the elevation body 610.

The dispenser 62 may further include a valve spring 640 built in the dispenser body 600 to elastically press the elevation body 610 downward.

The dispenser body 600 may be mounted on the dispensing valve mounting part 214 disposed on the center cover 213.

The dispenser channel 611 may include a first dispenser channel 612 disposed to be inclined along the dispenser body 600 and a second dispenser channel 613 that is bent from a front end of the first dispenser channel 612 downward.

The beverage guided to the beverage dispensing channel 61 may sequentially pass through the first dispenser channel 612 and the second dispenser channel 613 when the elevation body 610 is opened and then drop down to the lower side of the second dispenser channel 613.

A channel accommodating space in which the dispenser channel 611 is accommodated may be defined in the dispenser body 600.

A manipulation protrusion 614 allowing a terminal 631 of the limit switch 630 to come into point contact with the elevation body 610 when ascending may protrude from the elevation body 610. When the elevation body 610 ascends, the terminal of the limit switch 630 may come into point contact with the elevation body 610. When the elevation body 610 descends, the point contact of the terminal of the limit switch 630 may be released. In some examples, the limit switch 630 may be an electrical switch connected to the controller, and the terminal 631 may be a metal plate having a planar shape and extending to the manipulation protrusion 614.

In some examples, a guide part 610A guiding the elevation body 610 in the vertical direction may be disposed on the dispenser body 600.

The lever 620 may be connected to a hinge 621 disposed on an upper portion of the elevation body 610. In the state in which the lever 620 is connected to the elevation body 610, the lever may stand up in the vertical direction or laid in the horizontal direction.

When the lever 620 is laid in the horizontal direction, the elevation body 610 may ascend to turn on the limit switch 630. When the lever 620 stands up in the vertical direction, the elevation body 610 may descend to turn off the limit switch 630.

The limit switch 630 may be electrically connected to the controller 440, and the controller 440 may control the beverage maker according to the turn on/off of the limit switch 630.

When the user manipulates the lever 620 in a direction in which the dispenser 62 is opened, the elevation body 610 may ascend to point-contact the limit switch, and the controller 440 may detect the opening of the dispenser 62. In some examples, when the user manipulates the lever 620 in a direction in which the dispenser 62 is closed, the elevation body 610 may descend to release the point-contact of the limit switch, and the controller 440 may detect the closing of the dispenser 62.

A switch mounting part 630A on which the limit switch 630 is mounted may be disposed on the dispenser body 600.

The valve spring 640 may be disposed inside the guide part 610A of the dispenser body 600 to elastically press the elevation body 610 downward.

The beverage dispensing valve 64 of the beverage dispenser 6 may be coupled to the rear surface of the center cover 213.

Figure 4:
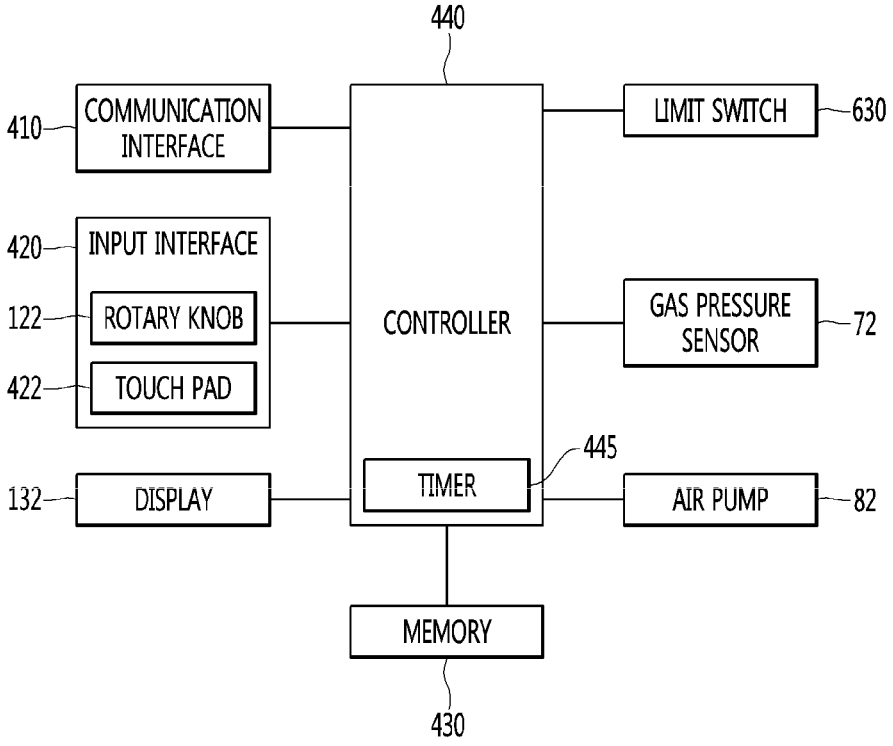
FIG. 4 is a schematic block diagram showing example control components of a beverage maker.

FIG. 4 is a schematic block diagram showing example control components of a beverage maker.

Referring to FIG. 4, the beverage maker may include a communication interface 410, the input interface 420, a memory 430, and a controller 440. Not all of the control components shown in FIG. 4 may be included in the beverage maker, and thus in some implementations, the beverage maker may include greater or fewer components.

The beverage maker may include the communication interface 410 for communicating a terminal (a smart phone, a tablet PC, or the like) or a server. For example, the controller 440 may receive a request for performing a function of making beverage, recipe information, or the like from a user terminal through the communication interface 410. The controller 440 may transmit various pieces of information on an operation of the beverage maker, a making state or a keeping state of beverage, or the like to a terminal or a server through the communication interface 410.

The communication interface 410 may include a module for supporting at least one of various known wired and wireless communication methods. For example, the communication interface 410 may include a short-distance wireless communication module such as Bluetooth or near field communication (NFC) or a wireless Internet module such as a wireless local area network (WLAN) module.

The input interface 420 may be provided to receive various requests or commands from the user. For example, the input interface 420 may include the rotary knob 122, the touch pad 422 (or a touchscreen), other buttons, a microphone, or the like. The controller 440 may receive a request for performing a function of making beverage, recipe information, and other control commands for various operation of the beverage maker through the input interface 420.

The display 132 may output various pieces of information related to an operation or a state of the beverage maker, and various pieces of information related to beverage that is made or kept in the beverage maker.

The display 132 may be implemented as a liquid crystal display (LCD), light emitting diode (LED), or organic light emitting diode (OLED) display, or the like. Here, in the specification, a description is given under the assumption that the display 132 is shaped like a circle, but the shape of the display 132 may be freely changed.

For example, the display 132 may output the information in the form of graphic or text. In some implementations, the beverage maker may further include a sound outputter for outputting the information in the form of voice, and the controller 440 may output the information in various combinations of graphic, text, and voice using the display 132 and the sound outputter.

The memory 430 may store various pieces of information or data related to an operation of the beverage maker. For example, the memory 430 may store preset recipe information on beverages to be made, various setting values, various program data for an operation of the beverage maker, or the like. The memory 430 may store various graphic data related to images displayed through the display 132.

The memory 430 may store an algorithm for calculating a dispensed amount based on pressure that is measured through the gas pressure sensor 72 and a time measured through a timer 445 when beverage is dispensed.

The controller 440 may control an overall operation of the beverage maker. Here, the controller 440 may refer to at least one controller. The at least one controller may implemented as hardware such as CPU, an application processor, a computer, a microcomputer ("micom"), an integrated circuit (IC), or an application specific integrated circuit (ASIC).

With regard to beverage dispensing, upon detecting the limit switch 630 to be turned on according to user manipulation of the lever 620, the controller 440 may measure a dispensing time using the timer 445. The controller 440 may measure pressure inside the fermentation container 12 using the gas pressure sensor 72 every reference time. The controller 440 may calculate a dispensed amount of beverage based on a dispensed amount calculation algorithm stored in the memory 430 and the measured pressure.

The controller 440 may control driving of the air pump 82 based on pressure inside the fermentation container 12, measured using the gas pressure sensor 72.

The user may have difficulty in recognizing the dispensed amount when dispensing beverage kept in the beverage maker. In addition, it may not be easy for the user to check a remaining amount of beverage kept in the beverage maker with the unaided eye.

Accordingly, the beverage maker may need to provide information on the dispensed amount of beverage or the remaining amount of the kept beverage to the user.

However, it may be difficult to include a component for detecting the amount of beverage, such as a flow sensor, inside the fermentation container 12 due to the characteristics of the fermentation container 12.

Accordingly, the beverage maker may measure pressure inside the fermentation container 12 and may effectively calculate a dispensed amount and a remaining amount. Implementations related thereto will be described below with reference to FIGS. 5 to 11.

Figure 5:
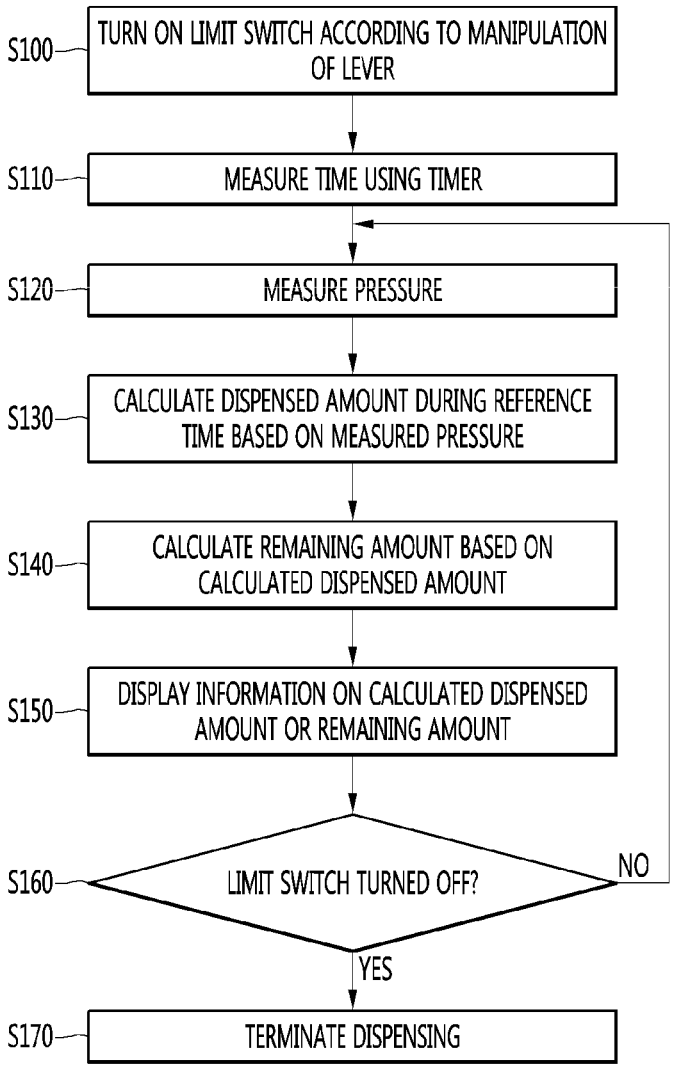
FIG. 5 is a flowchart showing an example operation of a beverage maker.

FIG. 5 is a flowchart showing an example operation of a beverage maker.

Referring to FIG. 5, when the limit switch 630 is turned on according to user manipulation of the lever 620 (S100), the beverage maker may measure a dispensing time using the timer 445 (S110).

In order to drink beverage kept in the fermentation container 12 of the beverage maker, the user may manipulate the lever 620 (e.g., the lever 620 is horizontally positioned).

The controller 440 may detect the limit switch 630 to be turned on according to manipulation of the lever 620. Upon detecting the limit switch 630 to be turned on, the controller 440 may open the beverage dispensing valve 64 and may open the beverage dispensing channel 61 to dispense beverage through the dispenser 62.

In some implementations, when a plurality of valves is disposed between the fermentation container 12 and the dispenser 62, the controller 440 may open the plurality of valves. Accordingly, beverage accommodated in the fermentation container 12 may be moved to the dispenser 62 and may be dispensed to the outside.

Upon detecting the limit switch 630 to be turned on, the controller 440 may control the timer 445 to measure a dispensing time.

The beverage maker may measure pressure inside the fermentation container 12 using the gas pressure sensor 72 (S120).

The controller 440 may control the gas pressure sensor 72 to measure pressure inside the fermentation container 12 while beverage is dispensed.

For example, the controller 440 may control the gas pressure sensor 72 to measure the pressure every reference time based on the dispensing time measured by the timer 445. The controller 440 may open and close the gas discharge valve 73 every reference time and may measure pressure of gas discharged through the gas discharge channel 71 when opening the gas discharge valve 73 using the gas pressure sensor 72.

The beverage maker may calculate a dispensed amount during a reference time based on the measured pressure (S130) and may calculate a remaining amount based on the calculated dispensed amount (S140).

A memory 450 may store an algorithm (e.g., mathematical expression) for calculating a dispensed amount during the reference time based on the measured pressure. The algorithm may be changed according to the performance or model of the beverage maker. For example, the memory 450 may be a non-transitory memory device or computer-readable media such as Random Access Memory (RAM).

The controller 440 may calculate a dispensed amount during the reference time (e.g., 1 second, 2 seconds, etc.) using the measured pressure and the algorithm, and may calculate a remaining amount of beverage based on the calculated dispensed amount. For example, the controller 440 may calculate the remaining amount of beverage through a difference between a remaining amount based on the stored remaining amount information and the calculated dispensed amount, based on the remaining amount information stored in the memory 430, and may update the remaining amount information stored in the memory 430.

An operation of calculating a dispensed amount of a beverage maker will be described below in more detail with reference to FIG. 6.

The beverage maker may display information on the calculated dispensed amount or remaining amount through the display 132 (S150).

The controller 440 may display information on the calculated dispensed amount or remaining amount through the display 132 in real time during beverage dispensing. Alternatively, the controller 440 may display the information on the dispensed amount or remaining amount through the display 132 after beverage is dispensed. One or more implementations related thereto will be described below with reference to FIGS. 7 and 8.

When the limit switch 630 is turned off according to user manipulation of the lever 620 (YES of S160), the beverage maker may terminate an operation of dispensing beverage (S170).

In order to terminate beverage dispensing, the user may manipulate the lever 620 (e.g., the lever 620 is vertically positioned).

The controller 440 may detect the limit switch 630 to be turned off according to manipulation of the lever 620. Upon detecting the limit switch 630 to be turned off, the controller 440 may close the beverage dispensing valve 64 in order to terminate beverage dispensing. In some implementations, the controller 440 may close a plurality of valves between the fermentation container 12 and the dispenser 62.

Upon detecting the limit switch 630 to be turned off, the controller 440 may detect pressure using the gas pressure sensor 72 and may calculate the dispensed amount and the remaining amount based on the detected pressure and a time between a current pressure detecting time and a pressure detecting time just before the current pressure detecting time.

When a state in which the limit switch 630 is turned is maintained (NO of S160), the controller 440 may continuously calculate the dispensed amount and the remaining amount every reference time like in operations S120 to S150.

In some implementations, the beverage maker may measure pressure and time during beverage dispensing and may continuously calculate a dispensed amount during the reference time, thereby effectively providing information on the dispensed amount and remaining amount of beverage to the user.

Figure 6:
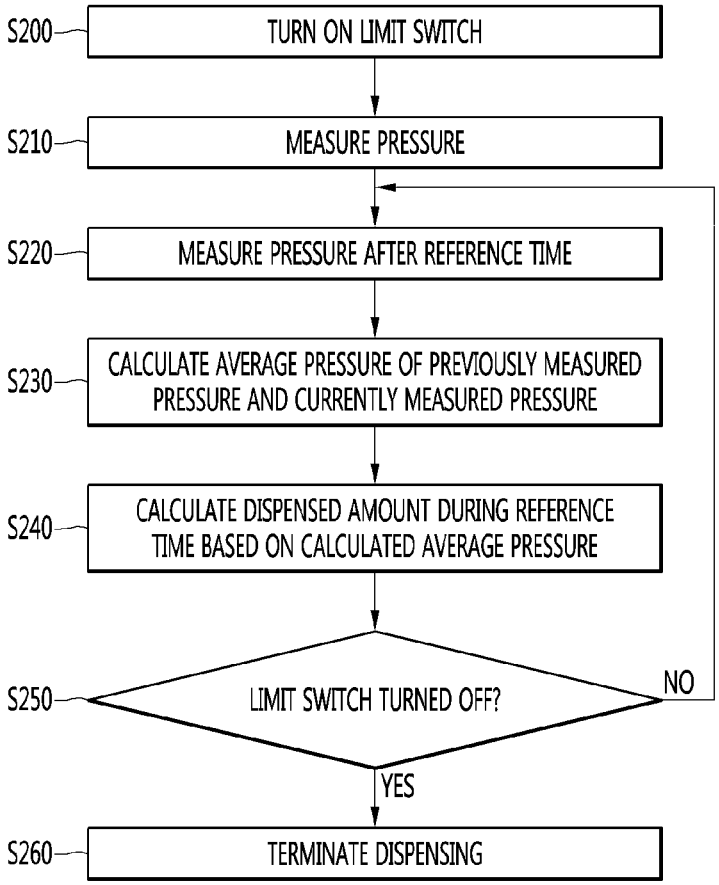
FIG. 6 is a flowchart showing an example operation of determining a dispensed amount of beverage.

FIG. 6 is a flowchart showing an example of a detailed operation of determining a dispensed amount of beverage of a beverage maker.

Referring to FIG. 6, as described above in operation S100, when the limit switch 630 is turned on (S200), the beverage maker may measure pressure inside the fermentation container 12 using the gas pressure sensor 72 (S210).

The controller 440 may begin beverage dispensing as the limit switch 630 is turned on, and may measure initial pressure inside the fermentation container 12 using the gas pressure sensor 72.

After the reference time from a time point of measuring pressure in operation S210, the beverage maker may measure pressure using the gas pressure sensor 72 (S220).

The beverage maker may calculate average pressure of previously measured pressure and currently measured pressure (S230) and may calculate a dispensed amount of beverage during the reference time based on the calculated average pressure (S240).

As beverage accommodated in the fermentation container 12 is dispensed to the outside through the dispenser 62, pressure inside the fermentation container 12 may be lowered as a time elapses.

Accordingly, in order to calculate the dispensed amount of beverage during the reference time, the controller 440 may calculate average pressure of the previously measured pressure and currently measured pressure at a time after the reference time from a time point of measuring the previously measured pressure.

The controller 440 may calculate the dispensed amount of beverage during the reference time using the calculated average pressure. As described above, the memory 430 may store an algorithm for calculating the dispensed amount during the reference time based on the measured pressure, and the controller 440 may calculate the dispensed amount of beverage during the reference time using the algorithm and the calculated average pressure.

When the limit switch 630 is not turned off (NO of S250), the beverage maker may measure pressure inside the fermentation container 12 after the reference time elapses in operation S220, and may calculate the dispensed amount during the reference time based on the average pressure of the previously measured pressure and the currently measured pressure.

For example, when the reference time is 1 second, the beverage maker may measure pressure every second to calculate the average pressure, and may continuously calculate the dispensed amount every second based on the calculated average pressure.

When the limit switch 630 is turned off (YES of S250), the beverage maker may terminate beverage dispensing (S260).

In some implementations, as described above with reference to FIG. 5, the controller 440 may detect pressure at a time of turning off the limit switch 630 and may calculate the average pressure of the previously measured pressure and the currently measured pressure. The controller 440 may calculate a time between a time of measuring the previously measured pressure and a time of turning off the limit switch 630, and the dispensed amount during the time based on the calculated average pressure.

Figure 7:
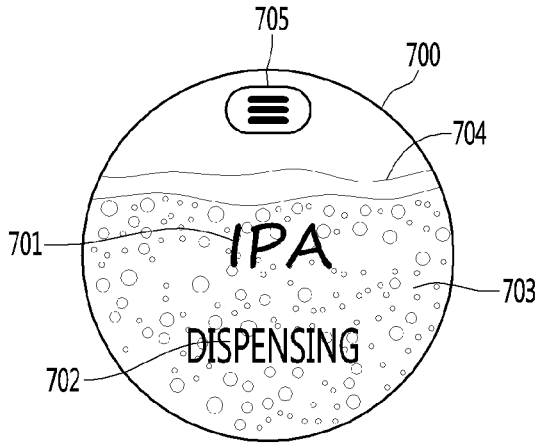
FIG. 7 is a diagram showing an example of an image displayed through a display while a beverage maker dispenses beverage.

FIG. 7 is a diagram showing an example of an image displayed through a display while a beverage maker dispenses beverage.

Referring to FIG. 7, the controller 440 may display a dispensing image 700 indicating that beverage is being dispensed through the display 132 during beverage dispensing.

For example, the dispensing image 700 may include a title 701 of beverage that is being dispensed (a beverage title or a recipe title), a dispensing text 702 indicating that dispensing is being performed, a graphic image 703 indicating the characteristics of beverage such as color or an amount of carbonic acid of beverage, a gage 704 indicating a remaining amount of beverage, and a menu item 705 for entrance into a menu.

As described above with reference to FIGS. 5 and 6, the controller 440 may calculate a dispensed amount every reference time during beverage dispensing. The controller 440 may calculate the remaining amount of beverage based on the calculated dispensed amount and may update the dispensing image 700 based on the calculated remaining amount.

For example, as beverage is continuously dispensed, the controller 440 may update the dispensing image 700 to lower the height of the gage 704 inside the dispensing image 700 as the remaining amount is reduced. Although not shown, the controller 440 may also numerically display the dispensed amount and/or the remaining amount of beverage through the dispensing image 700.

That is, the user may intuitively check information on the dispensed amount and/or remaining amount of beverage through the dispensing image 700, thereby enhancing use convenience of the beverage maker.

Figure 8:
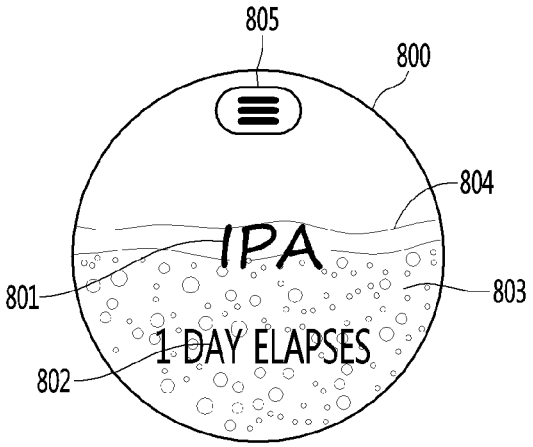
FIG. 8 is a diagram showing an example of an image displayed through a display by a beverage maker after beverage dispensing is terminated.

FIG. 8 is a diagram showing an example of an image displayed through a display by a beverage maker after beverage dispensing is terminated.

Referring to FIG. 8, after beverage dispensing is terminated, the controller 440 may display a keeping state image 800 related to beverage kept in the fermentation container 12. For example, the keeping state image 800 may include a title 801 of kept beverage (a beverage title or a recipe title), a state text 802 indicating a keeping state such as a keeping period or temperature, a graphic image 803 indicating the characteristics of beverage such as color or an amount of carbonic acid of beverage, a gage 804 indicating a remaining amount of kept beverage, and a menu item 805 for entrance into a menu.

The controller 440 may calculate the dispensed amount and remaining amount of beverage every reference time during beverage dispensing. After beverage dispensing is terminated, the controller 440 may adjust the height of the gage 804 based on the remaining amount of the lastly calculated beverage to update the keeping state image 800. Although not shown, the controller 440 may also numerically display the remaining amount of kept beverage through the keeping state image 800.

That is, the user may intuitively check information on the remaining amount after beverage dispensing is terminated, through the keeping state image 800, thereby enhancing use convenience of the beverage maker.

Pressure inside the fermentation container 12 may be continuously reduced during beverage dispensing. In this case, when pressure inside the fermentation container 12 is reduced lower than predetermined pressure, beverage in the fermentation container 12 may not be smoothly dispensed.

Accordingly, the beverage maker may adjust pressure between the fermentation tank 112 and the fermentation container 12, and thus pressure inside the fermentation container 12 may be increased to predetermined pressure or greater to smoothly dispense beverage. Implementations related thereto will be described below with reference to FIGS. 9 to 11.

Figure 9:
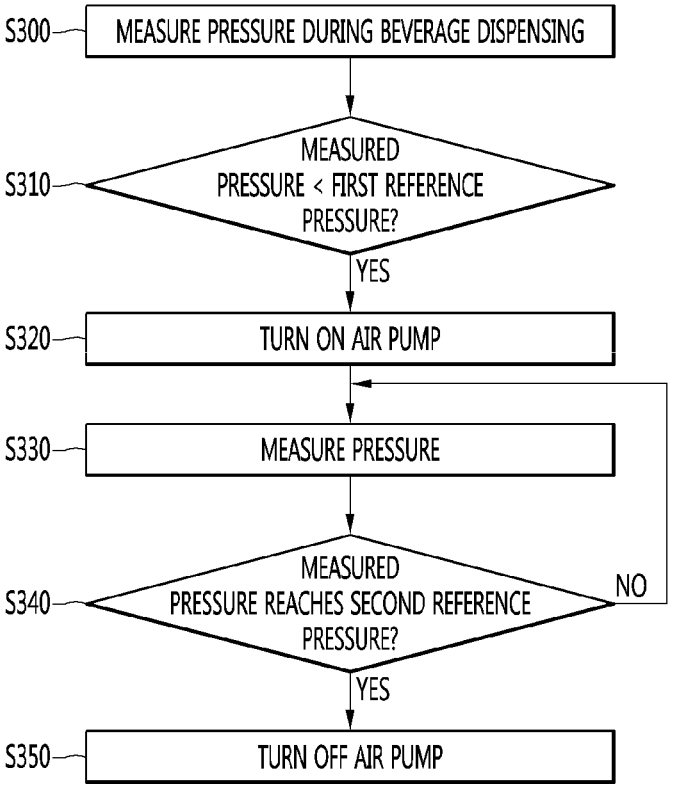
FIG. 9 is a flowchart showing an example operation of controlling an air pump during beverage dispensing.

FIG. 9 is a flowchart showing an example operation of controlling an air pump during beverage dispensing of a beverage maker.

Referring to FIG. 9, as described above with reference to FIGS. 5 and 6, the beverage maker may measure pressure inside the fermentation container 12 using the gas pressure sensor 72 during beverage dispensing (S300).

As described above with reference to FIGS. 5 and 6, in order to calculate the dispensed amount of beverage, the controller 440 may measure pressure inside the fermentation container 12 every reference time using the gas pressure sensor 72.

When the measured pressure is lower than first reference pressure (YES of S310), the beverage maker may turn on the air pump 82 (S320).

As beverage dispensing proceeds, the remaining amount of beverage kept in the fermentation container 12 may be reduced. As the remaining amount of beverage is reduced, pressure inside the fermentation container 12 may also be reduced.

In this case, when pressure inside the fermentation container 12 is reduced lower than predetermined pressure, beverage in the fermentation container 12 may not be smoothly dispensed.

That is, when pressure inside the fermentation container 12 is reduced lower than preset first reference pressure, the controller 440 may turn on the air pump 82. In addition, the controller 440 may close the bypass valve 35 and the ingredient supply valve 310 and may open the air supply valve 159.

Accordingly, air injected by the air pump 82 may be injected into a space between the fermentation tank 112 and the fermentation container 12 through the air injection channel 81, the first main channel 41, and the air supply channel 154.

The fermentation container 12 may be pressed to the inside from the outside by air injected into the space between the fermentation tank 112 and the fermentation container 12. The volume of the fermentation container 12 may be reduced by pressurization due to air injection of the air pump 82, and as the volume is reduced, pressure inside the fermentation container 12 may be increased.

The beverage maker may measure pressure inside the fermentation container 12 every reference time using the gas pressure sensor 72 (S330). When the measured pressure reaches second reference pressure (YES of S340), the beverage maker may turn off the air pump 82 (S350).

The second reference pressure may be higher than the first reference pressure.

When the limit switch 630 is turned on, the controller 440 may measure pressure inside the fermentation container 12 every reference time and may continuously calculate the dispensed amount during the reference time, irrespective of driving of the air pump 82.

When the air pump 82 is turned on in operation S320, pressure inside the fermentation container 12 may be increased. When the pressure is excessively increased, there is concern over a problem in that the fermentation container 12, the fermentation tank 112, or the beverage maker is damaged. Accordingly, when pressure measured every reference time reaches the second reference pressure (or the second reference pressure or greater), the controller 440 may turn off the air pump 82.

In some implementations, beverage dispensing may be terminated before the measured pressure reaches the second reference pressure. In this case, after beverage dispensing is terminated, the controller 440 may also periodically measure pressure using the gas pressure sensor 72, and when the measured pressure reaches the second reference pressure, the controller 440 may turn off the air pump 82. The controller 440 may close the air supply valve 159 when the air pump 82 is turned off, and thus may prevent air between the fermentation tank 112 and the fermentation container 12 from being discharged through the air supply channel 154.

Figure 10:
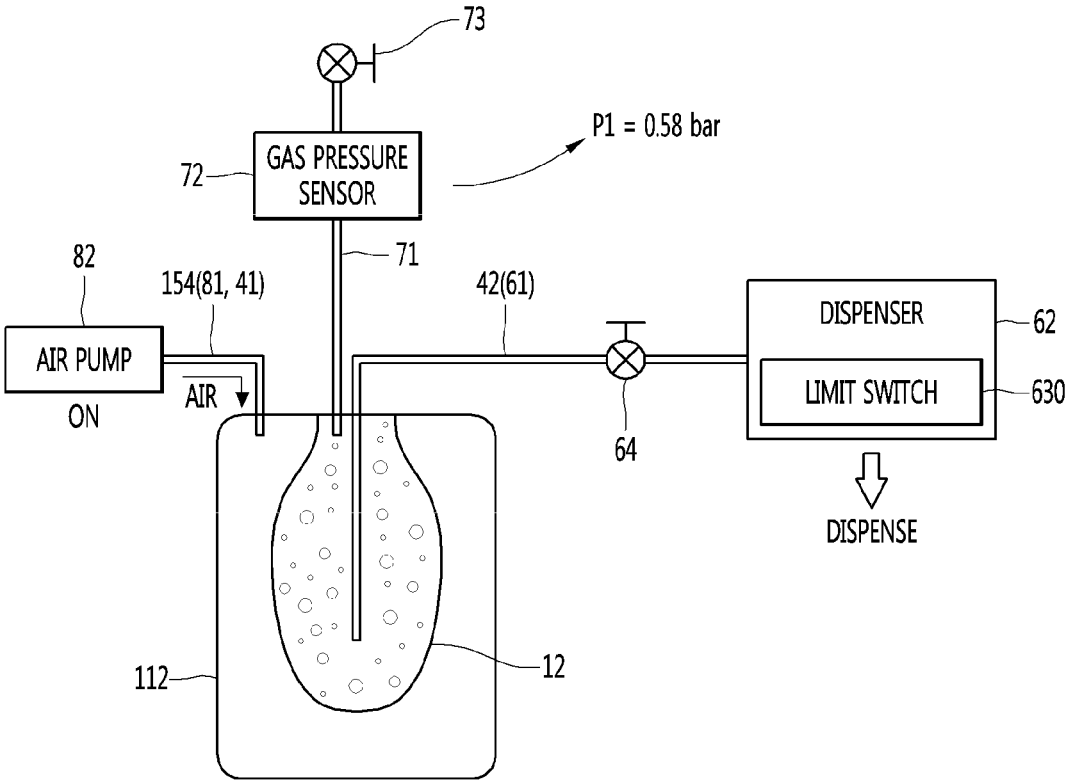
FIGS. 10 and 11 are diagrams showing example operations of the beverage maker shown in FIG. 9.
Figure 11:
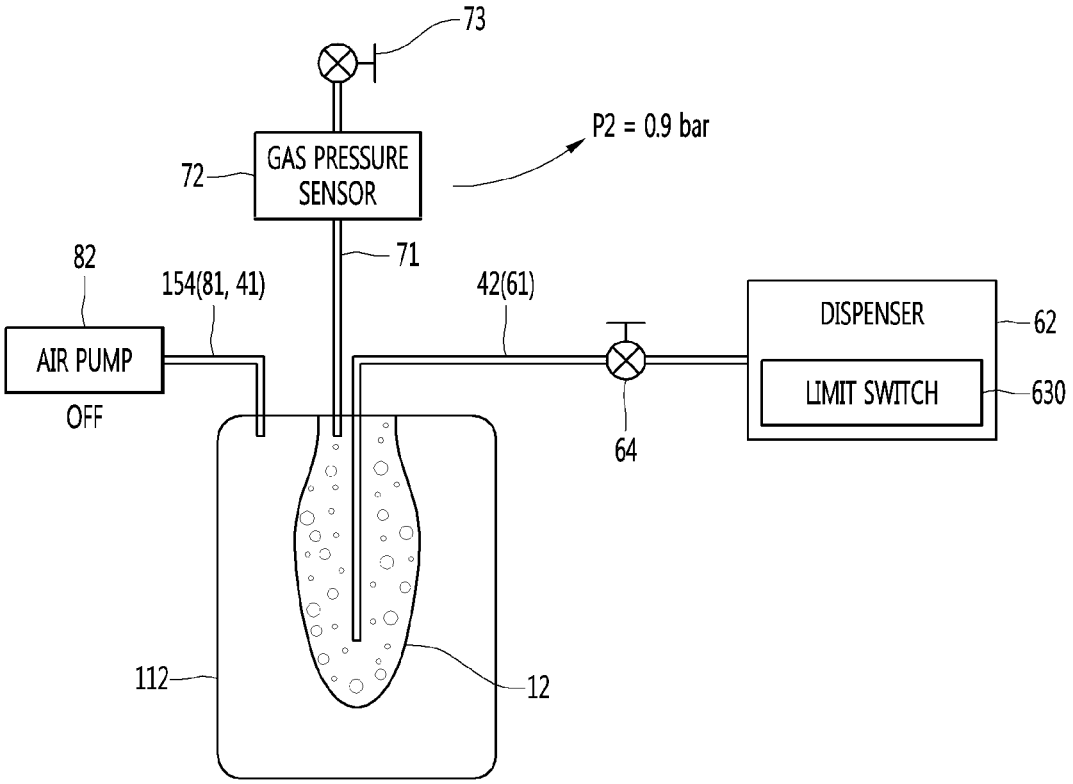

FIGS. 10 and 11 are diagrams showing an example related to an operation of the beverage maker shown in FIG. 9.

FIGS. 10 and 11 are schematic diagrams showing some components of the beverage maker shown in FIG. 1.

Referring to FIG. 10, when the limit switch 630 is turned on, the controller 440 may open the beverage dispensing valve 64. In some implementations, the controller 440 may also open the main valve 40 disposed in the second main channel 42.

As the beverage dispensing valve 64 and the main valve 40 are opened, beverage in the fermentation container 12 may be moved to the dispenser 62 through the second main channel 42 and the beverage dispensing channel 61 and may be discharged to the outside through the dispenser channel 611.

In this case, the controller 440 may instantaneously open/close the gas discharge valve 73 disposed in the gas discharge channel 71 every reference time and may measure pressure P1 inside the fermentation container 12 using the gas pressure sensor 72.

For example, when the first reference pressure described above with reference to FIG. 9 is 0.6 bar and the measured pressure P1 is 0.58 bar that is lower than the first reference pressure, the controller 440 may turn on the air pump 82. The controller 440 may open the air supply valve 159 and may close the bypass valve 35 and the ingredient supply valve 310.

As the air pump 82 is turned on, air (AIR) may be injected into a space between the fermentation tank 112 and the fermentation container 12 through the air supply channel 154 (in more detail, the air injection channel 81, the first main channel 41, and the air supply channel 154).

Referring to FIG. 11, the fermentation container 12 may be internally pressed by the air (AIR) injected into the space between the fermentation tank 112 and the fermentation container 12. The volume of the fermentation container 12 may be reduced by pressurization, and as the volume is reduced, pressure inside the fermentation container 12 may be increased.

The controller 440 may periodically measure pressure using the gas pressure sensor 72, and when the measured pressure reaches the second reference pressure described above with reference to FIG. 9, the controller 440 may turn off the air pump 82.

When the limit switch 630 is turned off before the measured pressure reaches the second reference pressure, the controller 440 may close the beverage dispensing valve 64 to terminate beverage dispensing. In this case, after beverage dispensing is terminated, the controller 440 may also periodically measure pressure inside the fermentation container 12 using the gas pressure sensor 72.

For example, when the second reference pressure is 0.9 bar and measured pressure P2 reaches 0.9 bar, the controller 440 may turn off the air pump 82 and may close the air supply valve 159. Accordingly, as pressure inside the fermentation container 12 is maintained in predetermined pressure, the fermentation container 12 or the like may be prevented from being damaged due to excessive pressure. In addition, beverage may be immediately and smoothly dispensed during next beverage dispensing.

In some implementations, as shown in FIGS. 9 to 11, the beverage maker may control the air pump 82 based on the pressure inside the fermentation container 12 during beverage dispensing, and thus may continuously maintain smooth beverage dispensing. After beverage dispensing is terminated, the pressure inside the fermentation container 12 may also be maintained in predetermined pressure, and thus beverage may be smoothly dispensed during next beverage dispensing.

In some implementations, where the beverage maker does not include a sensor for detecting flow therein, a dispensed amount and a remaining amount may be effectively calculated using pressure and time that are measured during beverage dispensing.

The beverage maker may provide information on the calculated dispensed amount and remaining amount to a user through a display or the like. Accordingly, the user may intuitively check information on the dispensed amount and/or remaining amount of beverage, thereby enhancing use convenience of the beverage maker.

In addition, the beverage maker may control the air pump to prevent pressure inside a fermentation container from being reduced lower than predetermined pressure during beverage dispensing, and thus may maintain smooth beverage dispensing. The beverage maker may also maintain the pressure in the fermentation container in the fermentation container after beverage dispensing is terminated, and thus beverage may be smoothly dispensed during next beverage dispensing.

The above-disclosed subject matter is to be considered illustrative, and not restrictive, and the appended claims are intended to cover all such modifications, enhancements, and other implementations, which fall within the scope of the present disclosure.

Thus, the implementation of the present disclosure is to be considered illustrative, and not restrictive.

Therefore, the scope of the present disclosure is defined not by the detailed description of the disclosure but by the appended claims, and all differences within the scope will be construed as being included in the present disclosure.

What is claimed is:

1. A beverage maker comprising:

a container configured to accommodate beverage therein;

a fermentation tank that accommodates the container therein;

a beverage dispenser configured to dispense the beverage, the beverage dispenser comprising a lever configured to control dispensing of the beverage and a limit switch configured to be turned on and off based on manipulation of the lever;

a beverage dispensing channel that connects the container and the beverage dispenser and that is configured to guide the beverage;

a beverage dispensing valve disposed in the beverage dispensing channel;

a pressure sensor configured to measure a gas pressure inside the container; and a controller configured to:

detect whether the limit switch is turned on, open the beverage dispensing valve to dispense the beverage accommodated in the container through the beverage dispenser based on detecting that the limit switch is turned on, determine a gas pressure value corresponding to the gas pressure inside the container measured by the pressure sensor, and determine a dispensed amount of beverage based on the gas pressure value, determine a first average pressure value of (i) a first gas pressure value corresponding to the gas pressure measured at a first time point and (ii) a second gas pressure value corresponding to the gas pressure measured at a second time point after an elapse of a reference duration from the first time point, based on the first average pressure value, determine an average amount of beverage dispensed during the reference duration between the first time point and the second time point, determine a third gas pressure value corresponding to the gas pressure inside the container measured based on detecting that the limit switch is turned off, determine a second average pressure value of the third gas pressure value and a fourth gas pressure value corresponding to the gas pressure measured at a time point prior to determination of the third gas pressure value, and based on the second average pressure value, determine an amount of beverage dispensed between the time point corresponding to the fourth gas pressure value and a time point corresponding to the third gas pressure value.

2. The beverage maker of claim 1, wherein the controller is configured to:

determine gas pressure values corresponding to the gas pressure inside the container measured at a plurality of reference time points, respectively; and determine an individual dispensed amount of beverage corresponding to each of the plurality of reference time points based on each of the gas pressure values.

3. The beverage maker of claim 1, wherein the controller is configured to determine a remaining amount of beverage accommodated in the container based on the dispensed amount of beverage.

4. The beverage maker of claim 3, further comprising:

a non-transitory memory device configured to store beverage information including a first remaining amount of beverage accommodated in the container, wherein the controller is configured to:

determine a second remaining amount of beverage based on a difference between the first remaining amount in the beverage information and the dispensed amount of beverage; and update the first remaining amount in the beverage information with the second remaining amount.

5. The beverage maker of claim 3, further comprising a display, wherein the controller is configured to display at least one of the dispensed amount of beverage or the remaining amount of beverage through the display.

6. The beverage maker of claim 1, further comprising an air pump configured to inject air to a space defined between the fermentation tank and the container, wherein the controller is configured to turn on the air pump based on the gas pressure value being less than a first reference pressure value.

7. The beverage maker of claim 6, wherein the controller is configured to turn off the air pump based on the gas pressure value being greater than or equal to a second reference pressure value that is greater than the first reference pressure value.

8. The beverage maker of claim 7, wherein the controller is configured to:

close the beverage dispensing valve;

after the beverage dispensing valve is closed, control the pressure sensor to measure the gas pressure based on detecting that the limit switch is turned off;

determine whether the gas pressure value is less than the second reference pressure value; and maintain the air pump to be turned off based on the gas pressure value being greater than or equal to the second reference pressure value.

9. The beverage maker of claim 1, wherein the beverage dispenser further comprises an elevation body connected to the lever and configured to move upward to thereby open the beverage dispensing channel based on manipulation of the lever, the elevation body comprising a manipulation protrusion that extends toward the limit switch and that is configured to contact the limit switch based on the elevation body moving upward.

10. The beverage maker of claim 9, wherein the limit switch comprises a terminal that extends to the elevation body and that is configured to contact the elevation body based on the elevation body moving upward.

* * * * *